US005950607A

United States Patent [19]

Osanai

[11] Patent Number: 5,950,607

[45] Date of Patent: Sep. 14, 1999

[54] EVAPORATED FUEL TREATMENT DEVICE OF AN ENGINE

[75] Inventor: Akinori Osanai, Susono, Japan

[73] Assignee: Toyota Jidosha Kabushiki Kaisha, Aichi-Ken, Japan

[21] Appl. No.: 08/910,242

[22] Filed: Aug. 13, 1997

[30] Foreign Application Priority Data

Aug. 13, 1996 [JP] Japan ..... 8-213717

[51] Int. Cl.[6] ..... F02D 41/16

[52] U.S. Cl. ..... 123/680; 123/698

[58] Field of Search ..... 123/680, 698, 123/520

[56] References Cited

U.S. PATENT DOCUMENTS

| | | | |
|---|---|---|---|
| 4,658,795 | 4/1987 | Kawashima et al. | 123/520 |
| 5,044,341 | 9/1991 | Henning et al. | 123/520 |
| 5,351,193 | 9/1994 | Poirier et al. | 123/520 |
| 5,469,833 | 11/1995 | Hara, et al. . | |
| 5,497,757 | 3/1996 | Osanai . | |
| 5,598,828 | 2/1997 | Osanai | 123/520 |
| 5,611,319 | 3/1997 | Machida | 123/680 |
| 5,676,118 | 10/1997 | Saito | 123/520 |
| 5,682,862 | 11/1997 | Sato et al. | 123/520 |
| 5,685,285 | 11/1997 | Ohtani et al. | 123/520 |
| 5,699,778 | 12/1997 | Muraguchi et al. | 123/520 |
| 5,778,859 | 7/1998 | Takagi | 123/520 |

FOREIGN PATENT DOCUMENTS

| | | |
|---|---|---|
| 195 117 81 | 10/1995 | Germany . |
| 63-189665 | 8/1988 | Japan . |
| 4370359 | 12/1992 | Japan . |
| 579410 | 3/1993 | Japan . |
| 5223021 | 8/1993 | Japan . |
| 7269419 | 10/1995 | Japan . |

OTHER PUBLICATIONS

Patent Abstracts of Japan, vol. 096, No. 001, Feb. 29, 1996 & JP 07 269419 A (Toyota Motor Corp.), Oct. 17, 1995.

*Primary Examiner*—Erick R. Solis
*Attorney, Agent, or Firm*—Kenyon & Kenyon

[57] ABSTRACT

An evaporated fuel treatment device comprising a purge control valve for controllling an amount of fuel vapor fed into the intake passage from a charcoal canister. At the time of restarting a purge action, the purge action is restarted by a low purge rate when the concentration of the fuel vapor to be purged into the intake passage rose to a predetermined concentration while the purge action was stopped and the engine was idling.

16 Claims, 21 Drawing Sheets

EVAPORATED FUEL TREATMENT DEVICE OF AN ENGINE

BACKGROUND OF THE INVENTION

1. Field of the Invention

The present invention relates to an evaporated fuel treatment device of an engine.

2. Description of the Related Art

In an internal combustion engine designed to have the evaporated fuel produced in the fuel tank etc. adsorbed once by activated carbon in a canister and to have the evaporated fuel adsorbed by the activated carbon purged in the engine intake passage, it is necessary to purge the evaporated fuel adsorbed by the activated carbon into the intake passage as fast as possible so as to keep the adsorption capacity of the activated carbon from becoming saturated. During engine operation, however, there is the problem that when the purge action is stopped once and then restarted in a state where a large amount of evaporated fuel is adsorbed by the activated carbon, if the purge rate is increased for purging the evaporated fuel from the activated carbon to the inside of the intake passage as fast as possible, a large amount of evaporated fuel will be purged into the intake passage the instant that the purge action is restarted, so the air-fuel ratio will fluctuate by a large margin.

Therefore, there is known an internal combustion engine designed so that when a large amount of evaporated fuel has been adsorbed by the activated carbon just before the purge action is stopped, that is, when the purge vapor concentration just before the purge action is stopped is high, the purge rate at the time of the restart of the purge action is made small and when the purge vapor concentration just before the purge action is stopped is low, the purge rate at the time of restart of the purge action is made large (see Japanese Unexamined Patent Publication (Kokai) No. 5-223021).

The amount of the evaporated fuel adsorbed by the activated carbon just before the purge action is stopped and the amount of evaporated fuel adsorbed by the activated carbon when the purge action is restarted, however, are not necessarily the same. When the fuel tank becomes high in temperature and a large amount of evaporated fuel is produced, a large amount of evaporated fuel is adsorbed by the activated carbon in the time from when the purge action is stopped to when the purge action is restarted. Therefore, if the purge rate is increased at the time of the restart of the purge action just because the purge vapor concentration was low just before the purge actoin was stopped as in the above internal combustion engine, a large amount of evaporated fuel will be purged into the intake passage the instant the purge action is restarted and therefore the problem will arise of a large fluctuation of the air-fuel ratio.

SUMMARY OF THE INVENTION

An object of the present invention is to provide an evaporated fuel treatment device capable of preventing an air-fuel ratio from fluctuating when the purge operation is started.

According to the present invention, there is provided an evaporated fuel treatment device for an engine provided with an intake passage, comprising a purge control valve for controlling an amount of purge of fuel vapor to be purged to the intake passage; purge control means for restarting the purge of the fuel vapor after the purge of the fuel vapor is stopped once during engine operation; judgement means for judging if the concentration of the fuel vapor to be purged into the intake passage has risen to a predetermined concentration or not during the period where the purge was stopped during engine operation; and restart purge rate control means for reducing the purge rate at the time of restart of the purge when the concentration of the fuel vapor has risen to the predetermined concentration during the period where the purge was stopped compared with the case where the concentration of the fuel vapor had not risen to the predetermined concentration.

BRIEF DESCRIPTION OF THE DRAWINGS

These and other objects and features of the present invention will become more apparent from the following description of the preferred embodiments given with reference to the attached drawings, in which.

DESCRIPTION OF THE PREFERRED EMBODIMENTS

Figure 1:
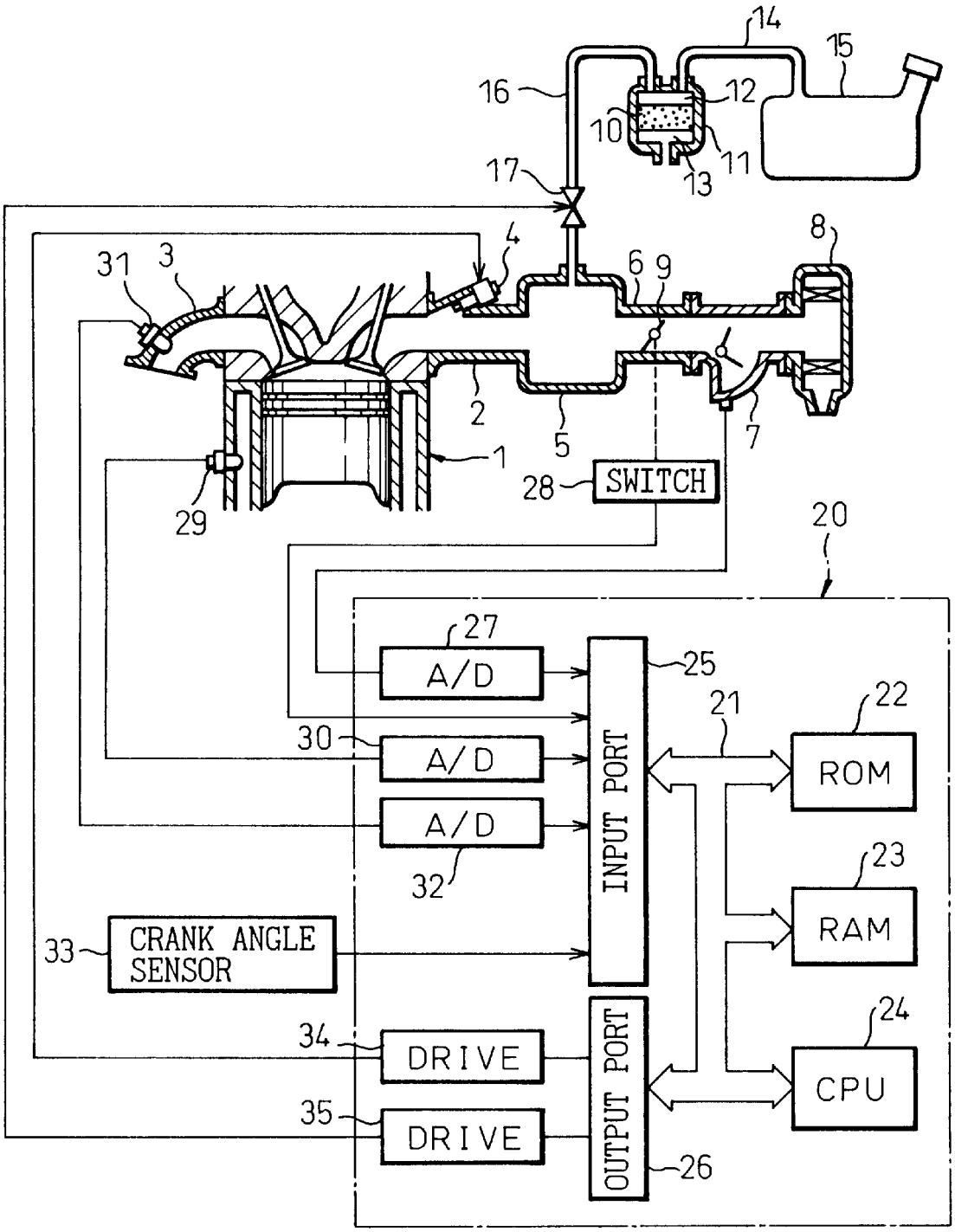
FIG. 1 is an overall view of an internal combustion engine.

Referring to FIG. 1, 1 is an engine body, 2 an intake tube, 3 an exhaust manifold, and 4 a fuel injector attached to each of the intake pipes 2. Each intake pipe 2 is connected to a common surge tank 5. The surge tank 5 is connected through an intake duct 6 and an air flow meter 7 to an air cleaner 8. In the intake duct 6 is arranged a throttle valve 9. Further, as shown in FIG. 1, the internal combustion engine has disposed in it a canister 11 containing activated carbon 10. The canister 11 has a fuel vapor chamber 12 and an atmospheric chamber 13 on the two sides of the activated carbon 10. The fuel vapor chamber 12 on the one hand is connected through a conduit 14 to a fuel tank 15 and on the other hand through a conduit 16 to the inside of the surge tank 5. In the conduit 16 is disposed a purge control valve 17 which is controlled by output signals from an electronic control unit 20. The fuel vapor which is generated in the fuel tank 15 is sent through the conduit 14 into the canister 11 where it is absorbed by the activated carbon 10. When the purge control valve 17 opens, the air is sent from the atmospheric chamber 13 through the activated carbon 10 into the conduit 16. When the air passes through the activated carbon 10, the fuel vapor which is absorbed in the activated carbon 10 is released from the activated carbon 10 therefore air containing the fuel vapor is purged through the conduit 16 to the inside of the surge tank 5.

The electronic control unit 20 is comprised of a digital computer and is provided with a read only memory (ROM) 22, a random access memory (RAM) 23, a microprocessor (CPU) 24, an input port 25, and an output port 26 connected to each other through a bidirectional bus 21. The air flow meter 7 generates an output voltage proportional to the amount of the intake air. This output voltage is input through the AD converter 27 to the input port 25. The throttle valve 9 has attached to it a throttle switch 28 which becomes on when the throttle valve 9 is at the idle open position. The output signal of the throttle switch 28 is input to the input port 25. The engine body 1 has attached to it a water temperature sensor 29 for generating an output voltage proportional to the coolant water temperature of the engine. The output voltage of the water temperature sensor 29 is input through the AD converter 30 to the input port 25. The exhaust manifold 3 has an air-fuel ratio sensor 31 attached to it. The output signal of the air-fuel ratio sensor 31 is input through the AD converter 32 to the input port 25. Further, the input port 25 has connected to it a crank angle sensor 33 generating an output pulse every time the crankshaft rotates by for example 30 degrees. In the CPU 24, the engine speed is calculated based on this output pulse. On the other hand, the output port 26 is connected through the corresponding drive circuits 34 and 35 to the fuel injectors 4 and the purge control valve 17.

In the internal combustion engine shown in FIG. 1, the fuel injection time TAU is calculated based fundamentally on the following equation:

$$TAU=TP\cdot\{K+FAF-FPG\}$$

where, the coefficients show the following:

TP: basic fuel injection time

K: correction coefficient

FAF: feedback correction coefficient

FPG: purge A/F correction coefficient

The basic fuel injection time TP is the experimentally found injection time required for making the air-fuel ratio the target air-fuel ratio. The basic fuel injection time TP is stored in advance in the ROM 22 as a function of the engine load Q/N (amount of intake air Q/engine speed N) and the engine speed N.

The correction coefficient K expresses the engine warmup increase coefficient and the acceleration increase coefficient all together. When no upward correction is needed, K is made 0.

The purge A/F correction coefficient FPG is for correction of the amount of injection when the purge has been performed. The period from when the engine operation is started to when the purge is started is FPG=0.

The feedback correction coefficient FAF is for controlling the air-fuel ratio to the target air-fuel ratio based on the output signal of the air-fuel ratio sensor 31. As the target air-fuel ratio, any air-fuel ratio may be used, but in the embodiment shown in FIG. 1, the target air-fuel ratio is made the stoichiometric air-fuel ratio, therefore the explanation will be made of the case of making the target air-fuel ratio the stoichiometric air-fuel ratio hereafter. Note that when the target air-fuel ratio is the stoichiometric air-fuel ratio, as the air-fuel ratio sensor 31, a sensor whose output voltage changes in accordance with the concentration of oxygen in the exhaust gas is used, therefore hereinafter the air-fuel ratio sensor 31 will be referred to as an $O_2$ sensor. This $O_2$ sensor 31 generates an output voltage of about 0.9V when the air-fuel ratio is rich and generates an output voltage of about 0.1V when the air-fuel ratio is lean. First, an explanation will be made of the control of the feedback correction coefficient FAF performed based on the output signal of this $O_2$ sensor 31.

Figure 2:
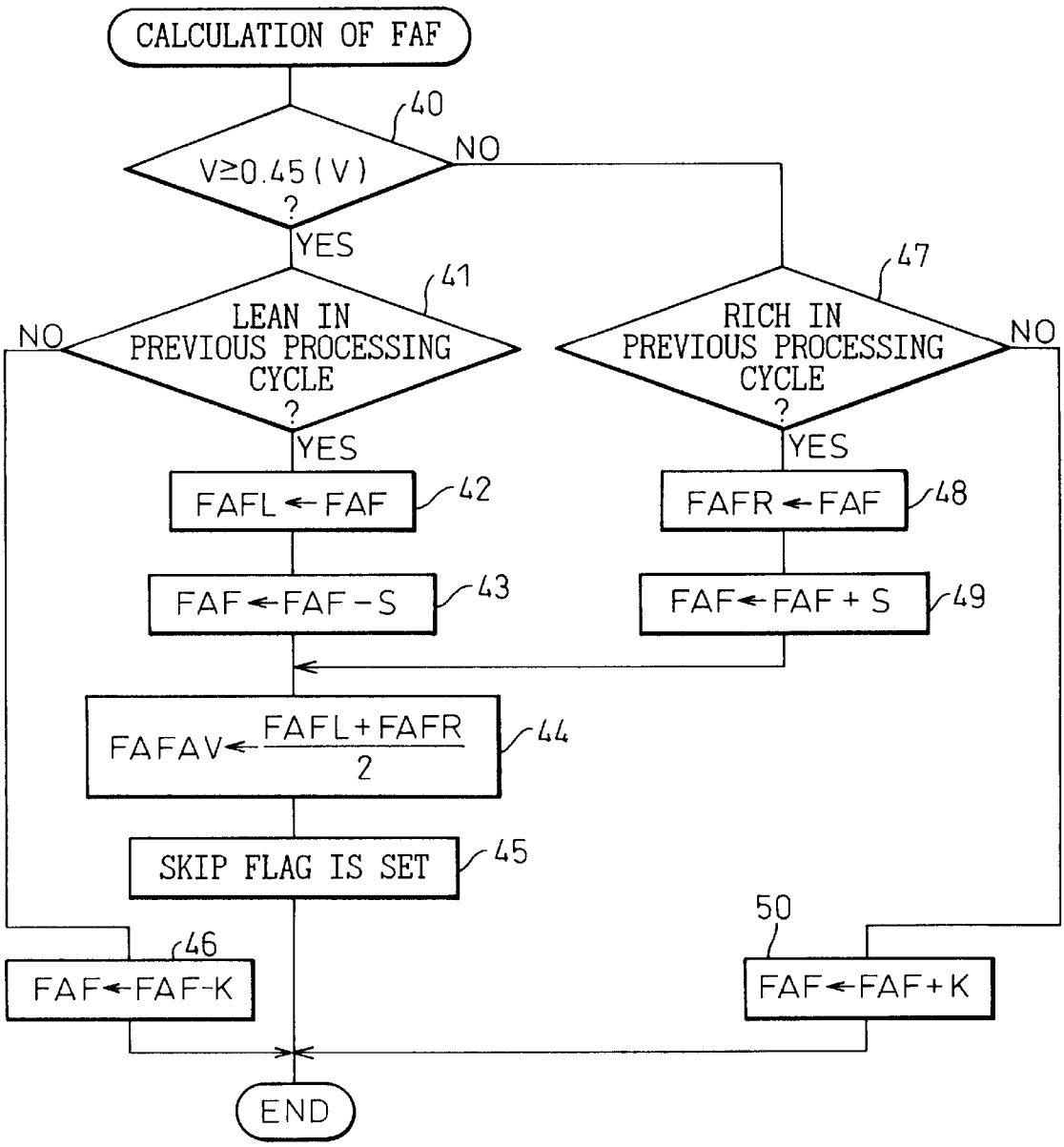
FIG. 2 is a flow chart of a routine for calculating an air-fuel ratio feedback correction coefficient FAF.

FIG. 2 shows the routine for calculation of the feedback correction coefficient FAF. This routine is executed for example within a main routine.

Figure 3:
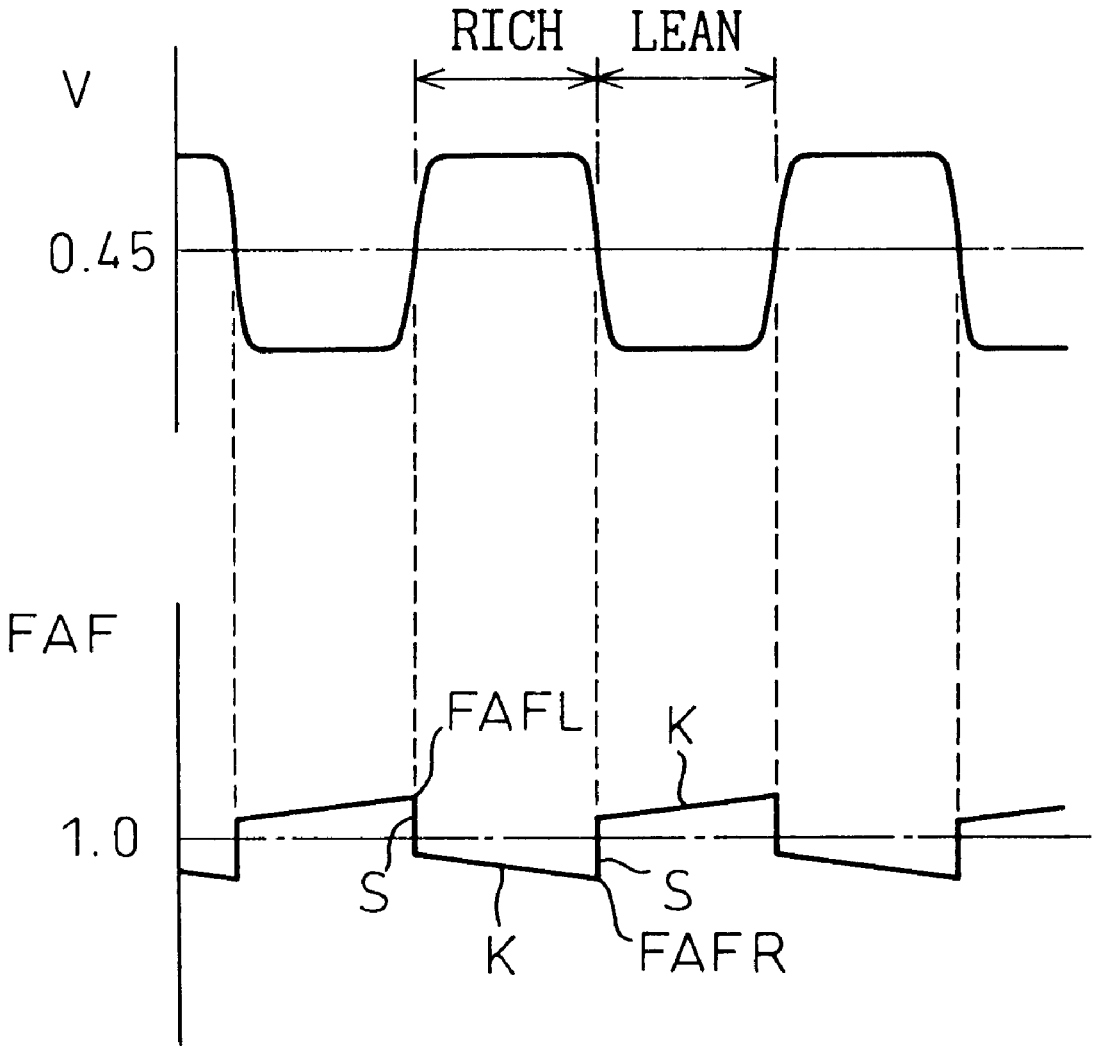
FIG. 3 is a view of the changes in the air-fuel ratio feedback correction coefficient FAF.

Referring to FIG. 2, first, at step 40, it is judged whether the output voltage of the $O_2$ sensor 31 is higher than 0.45V or not, that is, whether the air-fuel ratio is rich or not. When $V \geqq 0.45V$, that is, when the air-fuel ratio is rich, the routine proceeds to step 41, where it is judged if the air-fuel ratio was lean at the time of the previous processing cycle or not. When it was lean at the time of the previous processing cycle, that is, when it has changed from lean to rich, the routine proceeds to step 42, where the feedback control coefficient FAF is made FAFL and the routine proceeds to step 43. At step 43, a skip value S is subtracted from the feedback control coefficient FAF, therefore, as shown in FIG. 3, the feedback control coefficient FAF is rapidly reduced by the skip value S. Next, at step 44, the average value FAFAV of the FAFL and FAFR is calculated. Next, at step 45, the skip flag is set. On the other hand, when it is judged at step 41 that the air-fuel ratio was rich at the time of the previous processing cycle, the routine proceeds to step 46, where the integral value K (K<<S) is subtracted from the feedback control coefficient FAF. Therefore, as shown in FIG. 3, the feedback control coefficient FAF is gradually reduced.

On the other hand, when it is judged at step 40 that $V<0.45V$, that is, when the air-fuel ratio is lean, the routine proceeds to step 47, where it is judged if the air-fuel ratio was rich at the time of the previous processing cycle. When it was rich at the time of the previous processing cycle, that is, when it changed from rich to lean, the routine proceeds to step 48, where the feedback control coefficient FAF is made FAFR and the routine proceeds to step 49. At step 49, the skip value S is added to the feedback control coefficient FAF, therefore, as shown in FIG. 3, the feedback control coefficient FAF is rapidly increased by exactly the skip value S. Next, when it was judged at step 44 that the air-fuel ratio was lean at the time of the previous processing cycle, the routine proceeds to step 50, where the integral value K is added to the feedback control coefficient FAF. Therefore, as shown in FIG. 3, the feedback control coefficient FAF is gradually increased.

When the air-fuel ratio becomes rich and FAF becomes smaller, the fuel injection time TAU becomes shorter, while when the air-fuel ratio becomes lean and the FAF increases, the fuel injection time TAU becomes longer, so the air-fuel ratio is maintained at the stoichiometric air-fuel ratio. Note that when the purge action is not performed, as shown in FIG. 3, the feedback control coefficient FAF fluctuates about 1.0. Further, as will be understood from FIG. 3, the average value FAFAV calculated at step 44 shows the average value of the feedback control coefficient FAF.

Next, an explanation will be made of a first embodiment of the purge control according to the present invention by referring to FIG. 4 to FIG. 7. FIG. 4 to FIG. 7 show the relationship between the throttle opening degree, the vehicle speed, the purge rate PGR of the fuel vapor in the intake passage, and the feedback correction coefficient FAF.

Figure 4:
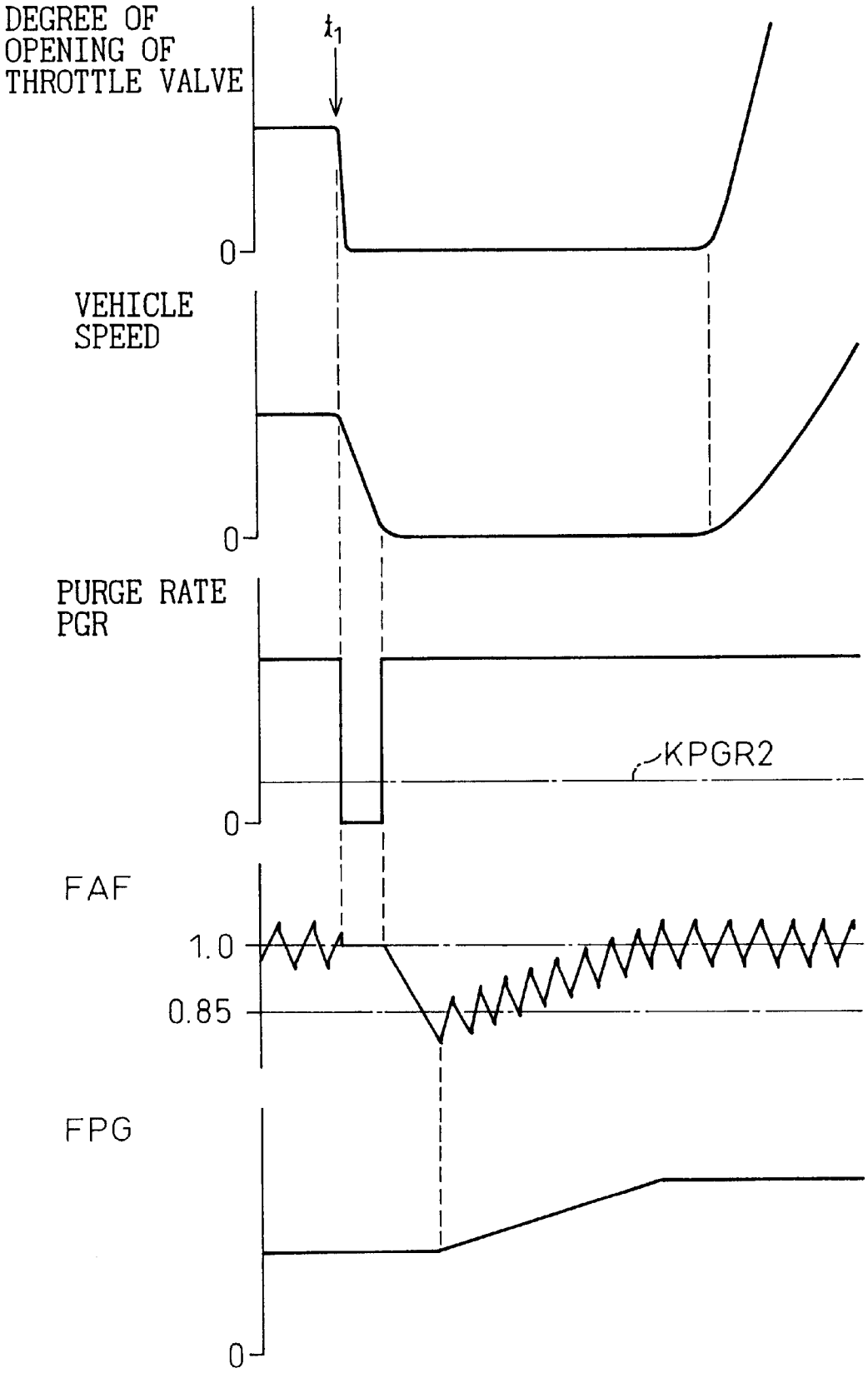
FIG. 4 is a time chart of changes in the purge rate PGR etc.

In this embodiment of the present invention, the supply of fuel is stopped during engine deceleration. When the supply of fuel is stopped, the action of purging the fuel vapor into the intake passage is stopped. In FIG. 4, the time $t_1$ shows when the deceleration operation has been started, therefore at this time the purge rate PGR is made zero. Next, when the fuel injection is restarted, the purge action is restarted by the purge rate PGR just before the purge action was stopped.

If for example the temperature of the fuel tank 15 is high, however, a large amount of fuel vapor will be generated in the fuel tank 15 while the purge action is stopped. Further, a large amount of fuel vapor will be adsorbed by the activated carbon 10 in the canister 11. Therefore, the concentration of the fuel vapor which is purged when the purge action is restarted will become considerably higher than the concentration of the fuel vapor which was purged just before the purge action was stopped and therefore the air-fuel ratio will fluctuate at the time of restart of the purge action.

On the other hand, the effect of a change in the concentration of the fuel vapor on the air-fuel ratio becomes larger the smaller the amount of intake air, therefore when the concentration of the fuel vapor changes, the effect appears most markedly when the engine operating state is an idling state, where the amount of intake air is small. Therefore, when the concentration of the fuel vapor to be purged has increased by a large margin while the purge action was stopped, if the purge action is restarted at the time of engine idling, the air-fuel ratio will fluctuate by a large margin. FIG. 4 shows the case where the purge action was restarted at the time of engine idling where the concentration of the fuel vapor to be purged increased by a large margin while the purge action was stopped.

In this case, when the purge action is restarted, the air-fuel ratio becomes rich, therefore the feedback correction coefficient FAF becomes small. Therefore, in the first embodiment, during engine idling, when the purge is restarted and the feedback correction coefficient FAF has become less than a predetermined set value, it is judged that the concentration of the fuel vapor to be purged has increased by a large margin while the purge action was stopped. If it is judged that the concentration of the fuel vapor to be purged has increased by a large margin while the purge action was stopped in this way, the purge rate is lowered so as to prevent the air-fuel ratio from fluctuating when the purge action is next restarted. Next, this will be explained with reference to FIG. 5 to FIG. 7.

Figure 5:
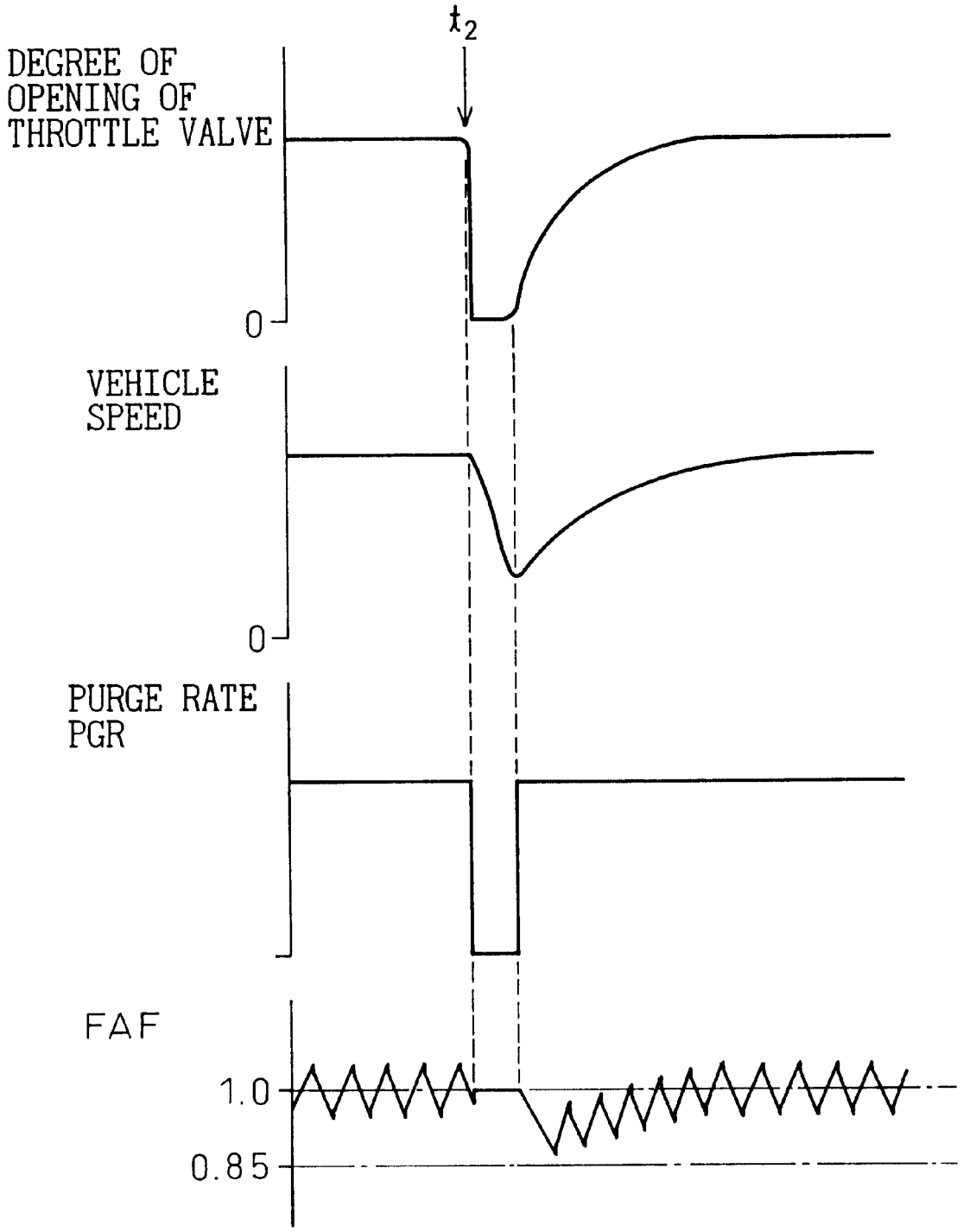
FIG. 5 is a time chart of changes in the purge rate PGR etc.
Figure 6:
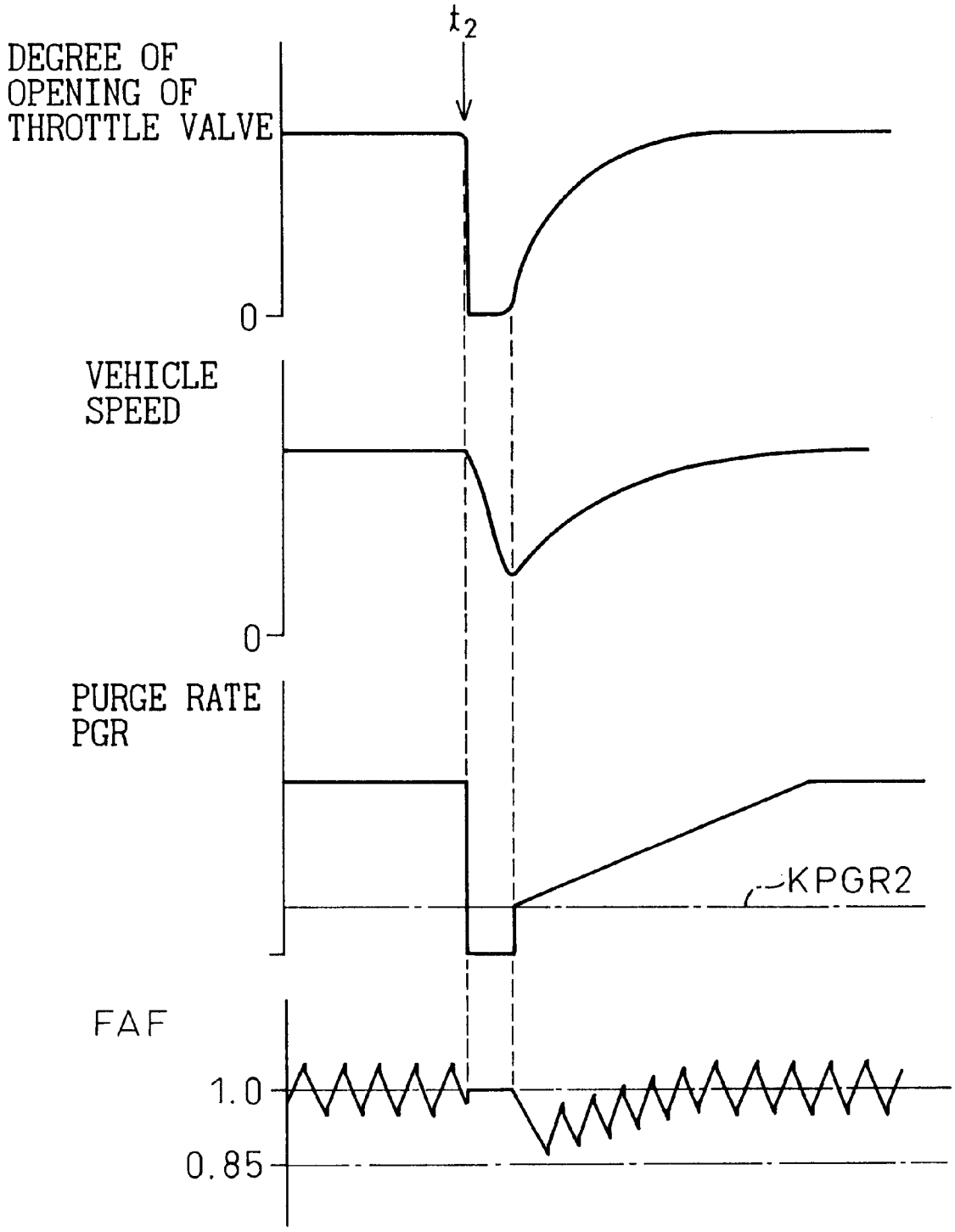
FIG. 6 is a time chart of changes in the purge rate PGR etc.
Figure 7:
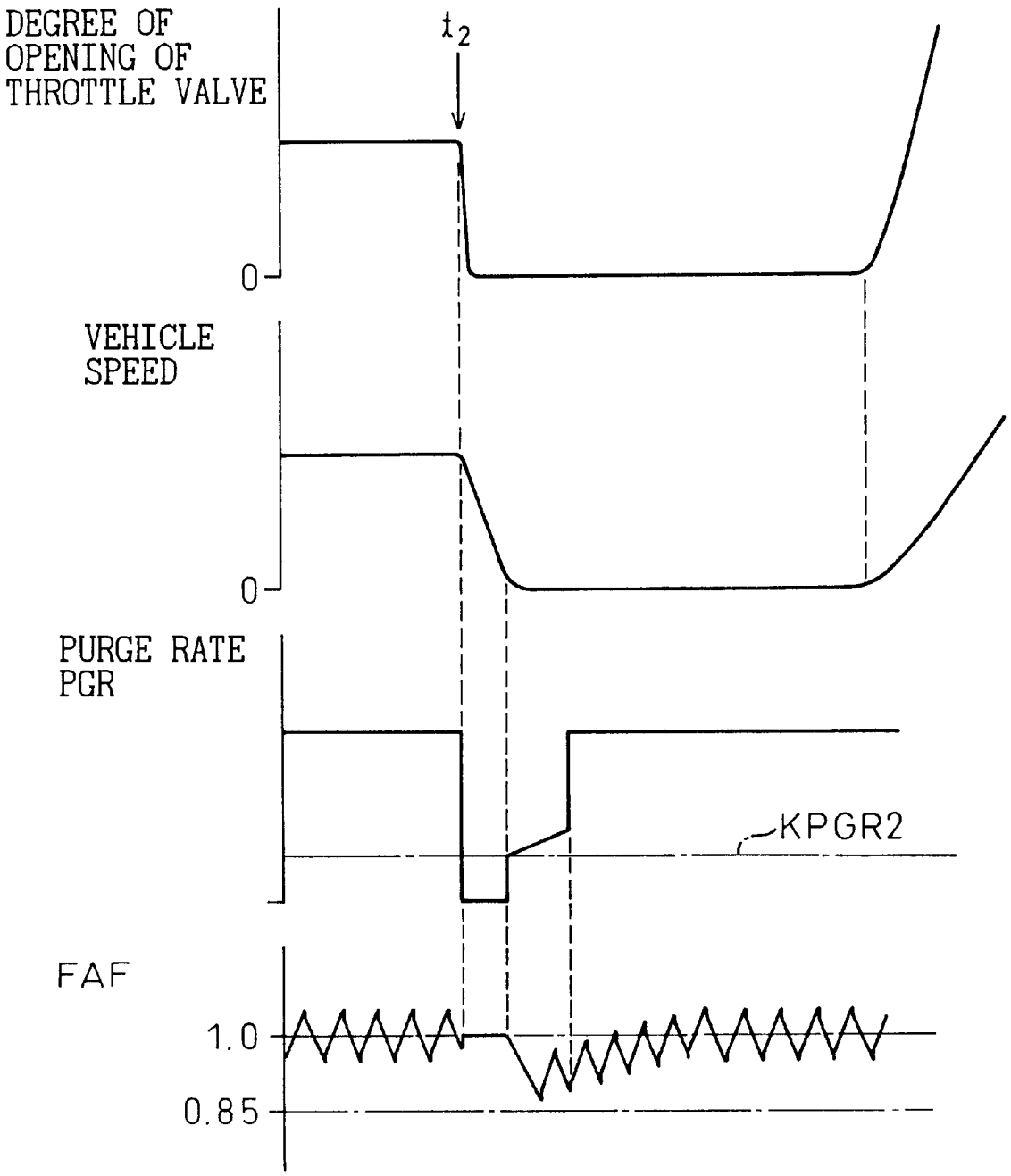
FIG. 7 is a time chart of changes in the purge rate PGR etc.

In FIG. 5 to FIG. 7, the time $t_2$ shows the case where the purge action was stopped once again after the purge action was stopped at the time $t_1$ of FIG. 4. FIG. 5 shows the case where it was judged that the concentration of the fuel vapor to be purged at the time of restart of the purge action shown in FIG. 4 has not changed that much while the purge action was stopped. In this case, as shown in FIG. 5, the purge rate PGR at the time of restart of the purge action is made the purge rate PGR of just before the purge action was stopped.

FIG. 6 shows the case where the concentration of the fuel vapor to be purged at the time of restart of the purge action shown in FIG. 4 has increased by a large margin while the purge action was stopped and where the purge action is restarted when the engine is not idling as shown in FIG. 6. In this case, the purge action is restarted by a predetermined purge rate KPGR2 lower than the purge rate PGR of just before the purge action was stopped, then the purge rate PGR is gradually increased. Next, when the purge rate PGR reaches a predetermined maximum purge rate, the purge rate PGR is maintained at that maximum purge rate. In this way, it is possible to prevent the air-fuel ratio from fluctuating by a large margin at the time of restart of the purge action by restarting the purge action from a low purge rate KPGR2.

On the other hand, FIG. 7 shows the case where the concentration of the fuel vapor to be purged at the time of restart of the purge action shown in FIG. 4 has increased by a large margin while the purge action was stopped and where the purge action is restarted when the engine is idling. In this case as well, the purge action is restarted by a predetermined purge rate KPGR2 lower than the purge rate PGR of just before the purge action was stopped. In this way, it is possible to prevent the air-fuel ratio from fluctuating by a large margin at the time of restart of the purge action by restarting the purge action from a low purge rate KPGR2.

Further, in this case as well, if the purge action is restarted, the purge rate PGR is gradually increased, but when the number of skip actions (S in FIG. 3) of the feedback correction coefficient FAF after restart of the purge action reaches a predetermined number, for example, three or more, the purge rate PGR is increased all at once to the purge rate of just before the purge action was stopped so as to promote the purge action.

Referring again to FIG. 4, FIG. 4 shows the change of the purge A/F correction coefficient FPG as well. As shown in FIG. 4, when the purge action is restarted, if the air-fuel ratio becomes rich, the feedback correction coefficient FAF will become smaller. Next, when the feedback correction coefficient FAF starts to rise, that is, when the air-fuel ratio starts to be maintained at the stoichiometric air-fuel ratio, the purge A/F correction coefficient FPG will gradually be increased and along with this FAF will be gradually returned to 1.0. Next, if FAF starts to fluctuate about 1.0, the purge A/F correction coefficient FPG will be maintained substantially constant. The value of the purge A/F correction coefficient FPG at this time shows the amount of fluctuation of the air-fuel ratio due to the purge of the fuel vapor.

If this purge A/F correction coefficient FPG is used to correct the fuel injection time TAU at the time when the purge action is being performed, the air-fuel ratio will not fluctuate so long as the concentration of the fuel vapor to be purged does not change sharply. Therefore, in this embodiment of the present invention, when the purge action is restarted after the purge action has once been stopped, the purge rate PGR at the time of restart of the purge action is in principle made the purge rate of just before the purge action was stopped.

If the concentration of the fuel vapor to be purged increases by a large margin while the purge action is stopped, however, the air-fuel ratio will fluctuate by a large margin when the purge action is restarted. Therefore, in the present invention, in this case, the purge rate PGR at the time of restart of the purge action is made the predetermined low purge rate KPGR2 as explained above. If the maximum purge rate is made 8 percent, the predetermined purge rate PGR will be a small value of about 2 percent. Below, this predetermined purge rate KPGR2 will be called the minimum purge rate.

Next, an explanation will be made of a first embodiment of a routine for control of the purge with reference to FIG. 8 to FIG. 11. Note that this routine is executed by interruption every predetermined time.

Figure 8:
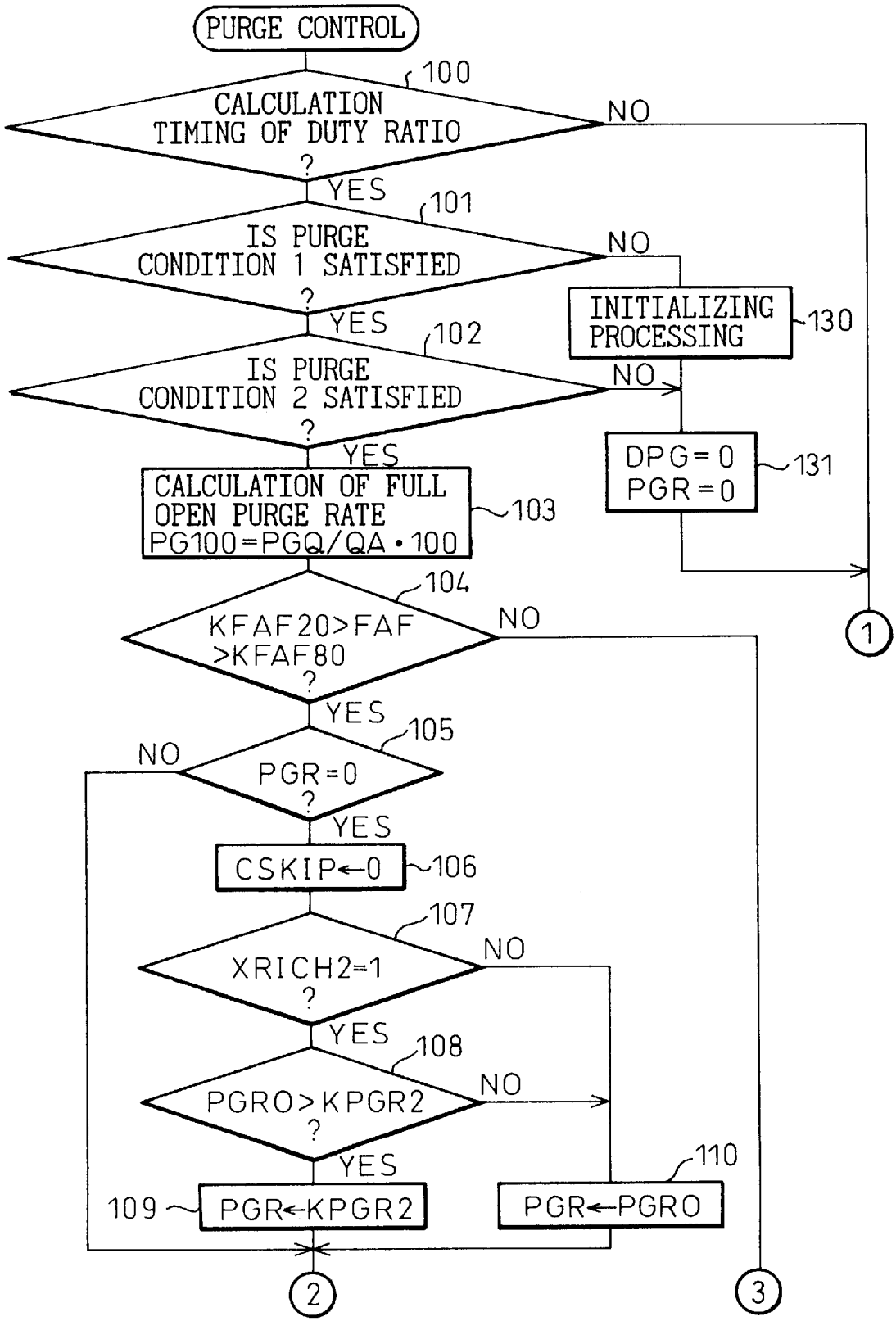
FIGS. 8 to 10 are flow charts of a first embodiment for the purge control.
Figure 9:
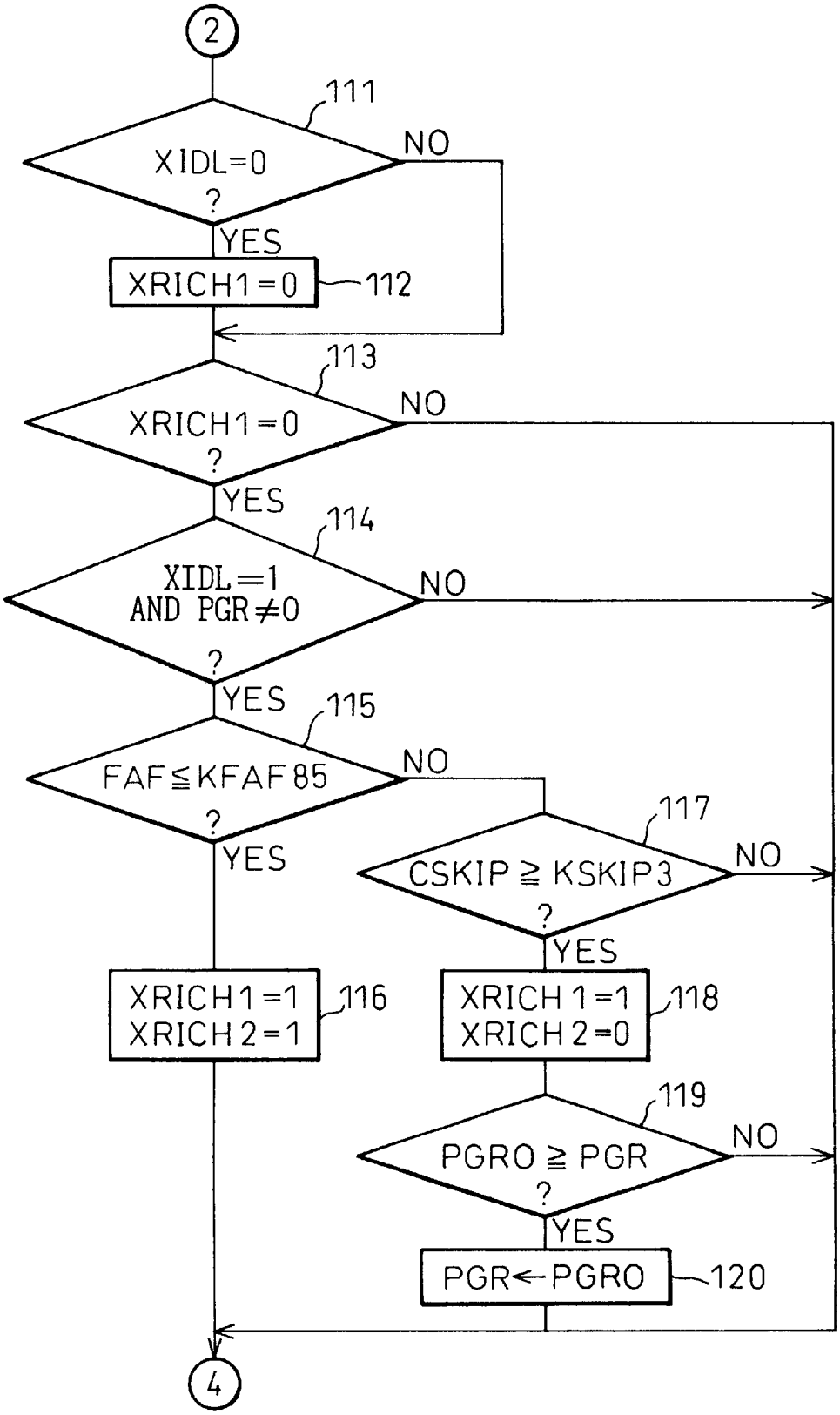
Figure 10:
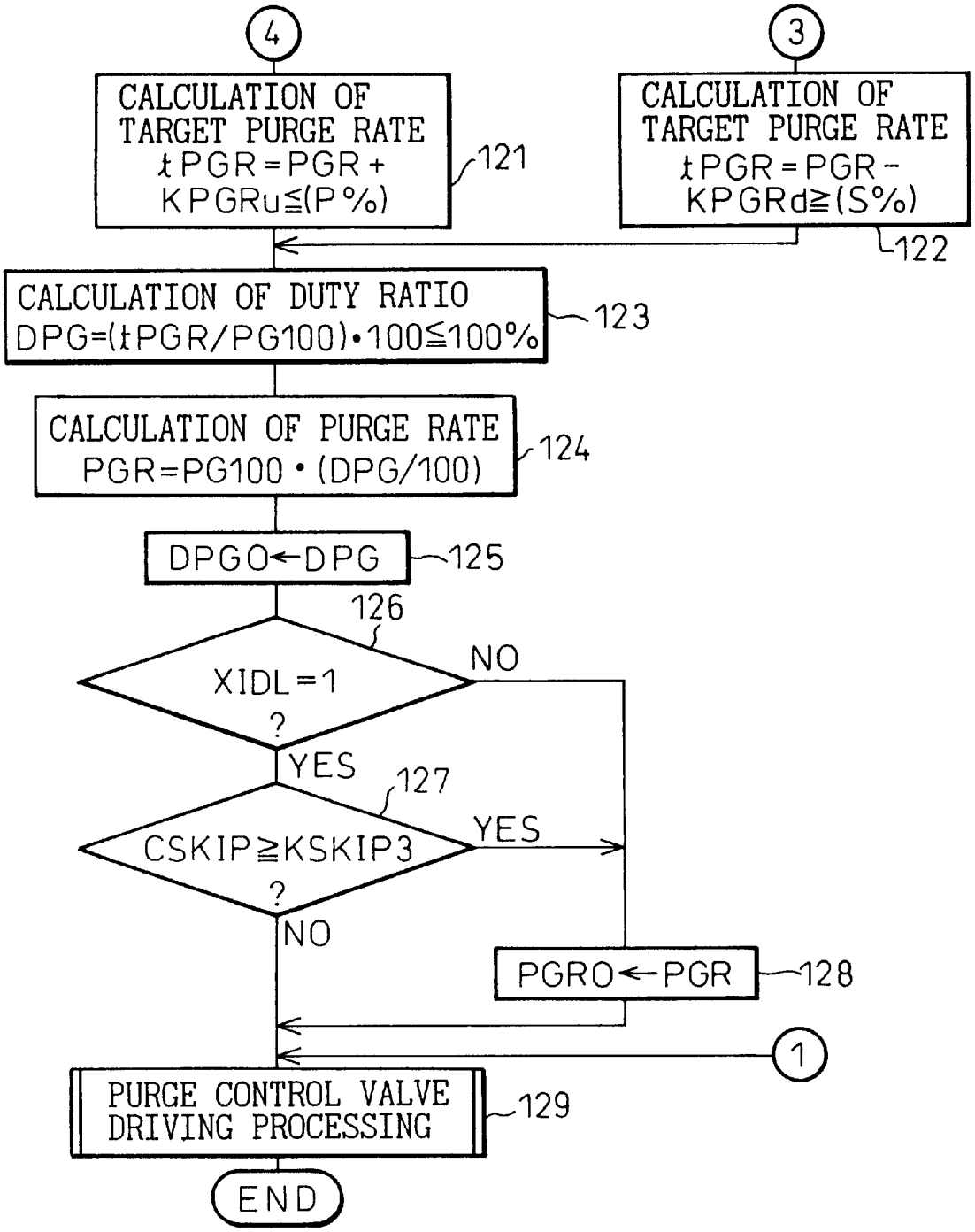

Referring to FIG. 8 to FIG. 10, first, at step 100, it is judged whether the time is the time of calculation of the duty ratio of the drive pulse of the purge control valve 17 or not.

In the embodiment according to the present invention, the duty ratio is calculated every 100 msec. When not the time for calculation of the duty ratio, the routine jumps to step 129, where the processing for driving the purge control valve 17 is executed. As opposed to this, when it is the time for calculation of the duty ratio, the routine proceeds to step 101, where it is judged if the purge condition 1 is satisfied or not, for example, if the engine warmup has been completed or not. When the purge condition 1 is not satisfied, the routine proceeds to step 130, where the initialization processing is performed, then at step 131, the duty ratio DPG and the purge rate PGR are made zero. As opposed to this, when the purge condition 1 is satisfied, the routine proceeds to step 102, where it is judged if the purge condition 2 is satisfied or not, for example, whether feedback control of the air-fuel ratio is being performed or not. When the purge condition 2 is not satisfied, the routine proceeds to step 131, while when the purge condition 2 is satisfied, the routine proceeds to step 103.

At step 103, the ratio between the full open purge amount PGQ and the amount QA of intake air, that is, the full open purge rate PG100 (=(PGQ/QA)·100) is calculated. Here, the full open purge amount PGQ shows the amount of purge when the purge control valve 17 is fully open. The full open purge rate PG100 is a function of for example the engine load Q/N (amount QA of intake air/engine speed N) and the engine speed N and is found in advance by experiments. It is stored in advance in the ROM 22 in the form of a map as shown in the following table.

TABLE 1

| | Q/N | | | | | | | | | | |
|---|---|---|---|---|---|---|---|---|---|---|---|
| N | 0.15 | 0.30 | 0.45 | 0.60 | 0.75 | 0.90 | 1.05 | 1.20 | 1.35 | 1.50 | 1.65 |
| 400 | 25.6 | 25.6 | 21.6 | 15.0 | 11.4 | 8.6 | 6.3 | 4.3 | 2.8 | 0.8 | 0 |
| 800 | 25.6 | 16.3 | 10.8 | 7.5 | 5.7 | 4.3 | 3.1 | 2.1 | 1.4 | 0.4 | 0 |
| 1600 | 16.6 | 8.3 | 5.5 | 3.7 | 2.8 | 2.1 | 1.5 | 1.2 | 0.9 | 0.3 | 0 |
| 2400 | 10.6 | 5.3 | 3.5 | 2.4 | 1.8 | 1.4 | 1.1 | 0.8 | 0.6 | 0.3 | 0.1 |
| 3200 | 7.8 | 3.9 | 2.5 | 1.8 | 1.4 | 1.1 | 0.9 | 0.6 | 0.5 | 0.4 | 0.2 |
| 4000 | 6.4 | 3.2 | 2.1 | 1.5 | 1.2 | 0.9 | 0.7 | 0.6 | 0.4 | 0.4 | 0.3 |

The lower the engine load QIN becomes, the larger the full open purge amount PGQ with respect to the amount QA of intake air becomes, so as shown in Table 1, the full open purge rate PG100 becomes larger the lower the engine load Q/N becomes and the full open purge amount PGQ with respect to the amount QA of intake air becomes larger the lower the engine speed N becomes, so as shown in Table 1, the full open purge rate PG100 becomes larger the lower the engine speed N.

Next, at step 104, it is judged if the feedback control coefficient FAF is between the upper limit value KFAF20 (=1.20) and the lower limit value KFAF80 (=0.80) or not. When KFAF20>FAF>KFAF80, that is, when the air-fuel ratio is being feedback controlled to the stoichiometric air-fuel ratio, the routine proceeds to step 105, where it is judged whether the purge rate PGR is zero or not. That is, when the purge action is being performed, PGR>0, so at this time the routine jumps to step 111. As opposed to this, when PGR=0, that is, the purge action is not performed and the purge should be restarted, the routine proceeds to step 106.

At step 106, the number of occurrences CSKIP of the skip action of the feedback correction coefficient FAF Is made zero. Next, at step 107, it is judged if the rich flag XRICH2 showing that the concentration of the fuel vapor to be purged has increased by a large margin while the purge action was stopped is set (XRICH2=1) or not. When the rich flag XRICH2 is reset (XRICH2=0), the routine proceeds to step 110, where the purge rate PGR0 of just before the purge action was stopped is made the restart purge rate PGR. Next, the routine proceeds to step 111. In this way, when the rich flag XRICH2 is not set at the time of restart of the purge action, the purge action is restarted by the purge rate PGR0 of just before the purge action was stopped.

On the other hand, when it is judged at step 107 that the rich flag XRICH2 has been set, the routine proceeds to step 108, where it is judged if the purge rate PGR0 of just before the purge action was stopped is larger than the minimum purge rate KPGR2 or not. When PGR0≦KPGR2, the routine proceeds to step 110, where the purge rate PGR0 of just before the purge action was stopped is made the restart purge rate PGR.

As opposed to this, when it is judged at step 108 that PGR0>KPGR2, the routine proceeds to step 109, where the minimum purge rate KPGR2 is made the restart purge rate PGR, then the routine proceeds to step 111. That is, even when the purge rate PGR0 of just before the purge action was stopped is larger than the minimum purge rate KPGR2, when the rich flag XRICH2 is set, the minimum purge rate KPGR2 is made the restart purge rate PGR.

Next, at step 111, it is judged if the idling flag XIDL, which is set when the engine operating state is an idling state, has been reset (XIDL=0) or not. When the idling flag XIDL is set (XIDL=1), that is, when the engine is idling, the routine jumps to step 113, while when the idling flag XIDL is reset, that is, the engine is not in the idling state, the routine proceeds to step 112, where the judgement completion flag XRICH1 is reset (XRICH1=0), then the routine proceeds to step 113. The judgement completion flag XRICH1 is set when the judgement of whether the air-fuel ratio has become rich at the time of purge restart has been completed (XRICH1=1).

At step 113, it is judged if the judgement completion flag XRICH1 has been reset or not. When the judgement completion flag XRICH1 is set, that is, when the judgement of a rich state of the air-fuel ratio is completed, the routine jumps to step 121. As opposed to this, when the judgement completion flag XRICH1 is reset, that is, the judgement of the rich state of the air-fuel ratio has not been completed, the routine proceeds to step 114, where it is judged if the condition for judgement of a rich state of the air-fuel ratio is satisfied or not. It is judged that the condition for judgement of a rich state of the air-fuel ratio is satisfied when the idling flag XIDL is set and the purge rate PGR is not zero, that is, during an engine idling operation where the purge action of the fuel vapor is performed. When the condition for judgement of a rich state of the air-fuel ratio is not satisfied, the routine jumps to step 121, while when the condition for judgement of a rich state of the air-fuel ratio is satisfied, the routine proceeds to step 115.

At step 115, it is judged if the feedback correction coefficient FAF has become smaller than the set value KFAF85 (=0.85) or not. When FAF>KFAF85, the routine proceeds to step 117, where it is judged if the number of occurrences CSKIP of the skip of the feedback correction coefficient FAF has exceeded a set number KSKIP3, for example, three times, or not. The fact that the number of occurrences of skips exceeds three means that the feedback control of the air-fuel ratio is stable. When CSKIP<KSKIP3, the routine jumps to step 112. As opposed to this, when CSKIP≧KSKIP3, the routine proceeds to step 118, where the judgement completion flag XRICH1 is set (XRICH1=1) and the rich flag XRICHK2 showing that the air-fuel ratio has become rich is reset (XRICHK2=0).

Next, at step 119, it is judged if the purge rate PGR0 of just before the purge action was stopped is higher than the current purge rate PGR or not. When PGR0<PGR, the routine jumps to step 121, while when PGR0≧PGR, the routine proceeds to step 120, where PGR0 is made PGR. That is, when the purge action is restarted while the engine is idling, until the feedback correction coefficient FAF is skipped three times, when FAF>KFAF85, if PGR0≧PGR, the purge rate PGR will be increased all at once to the purge rate PGR0 of just before the purge action was stopped. If the skip action of the feedback correction coefficient FAF is performed three times, the air-fuel ratio is being maintained at the stoichiometric air-fuel ratio stably. If the air-fuel ratio is stable in this way, even if the purge rate PGR changes sharply, the air-fuel ratio will not fluctuate that much. Therefore, in this embodiment, when the air-fuel ratio is stable after the restart of the purge action, the purge rate PGR is made to increase all at once.

On the other hand, when it is judged at step 115 that FAF≦KFAF85, the routine proceeds to step 116, where the judgement completion flag XRICH1 is set (XRICH1==1) and the rich flag XRICH2 is set (XPGTNK2=1). That is, if FAF≦KFAF85 befefore the skip action of the feedback correction coefficient FAF occurs three times, the rich flag XRICH2 is set. Until the skip action of the feedback correction coefficient FAF is performed three times, the rich flag XRICH2 will be reset if FAF>KFAF85. The fact that FAF≦KFAF85 means that the air-fuel ratio is rich, therefore when the air-fuel ratio becomes rich, the rich flag XRICH2 is set.

At step 121, the target purge rate tPGR (=PGR+KPRGu) is calculated by adding a constant value KPGRu to the purge rate PGR. That is, when KFAF20>FAF>KFAF80, it is understood, the target purge rate tPGR is gradually increased every 100 msec. Note that an upper limit purge rate is set for this target purge rate tPGR, therefore the target purge rate tPGR can only rise up to this upper limit purge rate. Next, the routine proceeds to step 123.

On the other hand, when it is judged at step 104 that FAF≧KFAF20 or FAF≦KFAF80, the routine proceeds to step 122, where the constant value KPGRd is subtracted from the purge rate PGR to calculate the target purge rate tPGR (=PGR−KPGRd). That is, when the air-fuel ratio cannot be maintained at the stoichiometric air-fuel ratio due to the purge action of the fuel vapor, the target purge rate tPGR is reduced. Note that a lower limit value S (S=0%) is set for the target purge rate tPGR. Next, the routine proceeds to step 123.

At step 123, the target purge rate tPGR is divided by the full open purge rate PG100 to calculate the duty ratio DPG (=(tPGR/PG100)·100) of the drive pulse of the purge control valve 17. Therefore, the duty ratio DPG of the drive pulse of the purge control valve 17, that is, the amount of opening of the purge control valve 17, is controlled in accordance with the ratio of the target purge rate tTPG to the full open purge rate PG100. If the amount of opening of the purge control valve 17 is controlled in accordance with the ratio of the target purge rate tTPG to the full open purge rate PG100 in this way, no matter what purge rate the target purge rate tTPG is, regardless of the engine operating state, the actual purge rate will be maintained at the target purge rate.

Suppose for example that the target purge rate tTPG is 2 percent and the full open purge rate PG100 at the current operating state is 10 percent. The duty ratio DPG of the drive pulse will become 20 percent and the actual purge rate at this time will become 2 percent. Next, supposing that the operating state changes and the full open purge rate PG100 at the changed operating state becomes 5 percent, the duty ratio DPG of the duty ratio will become 40 percent and the actual purge ratio at this time will become 2 percent. That is, if the target purge rate tTPG is 2 percent, the actual purge rate will become 2 percent regardless of the engine operating state. If the target purge rate tTPG changes and becomes 4 percent, the actual purge rate will be maintained at 4 percent regardless of the engine operating state.

Next, at step 124, the full open rate PG100 is multiplied by the duty ratio DPG to calculate the actual purge rate PGR (=PG100·(DPG/100)). That is, as explained above, the duty ratio DPG is expressed by (tPGR/PG100)·100. In this case, when the target purge rate tPGR becomes larger than the full open purge rate PG100, the duty ratio DPG would become more than 100 percent. The duty ratio DPG, however, cannot become more than 100 percent. At this time, the duty ratio DPG is made 100 percent, therefore the actual purge rate PGR becomes smaller than the target purge rate tPGR. Accordingly, the actual purge rate PGR is expressed by PG100·(DPG/100) as explained above.

Next, at step 125, the duty ratio DPG is made DPG0. Next, at step 126, it is judged if the idling flag XIDL is set or not. When the idling flag XIDL is reset, the routine proceeds to step 128, where the purge rate PGR is made PGR0. As opposed to this, when the idling flag XIDL is set, the routine proceeds to step 127, where it is judged if the number of occurrences CSKIP of the skip action has exceeded the set value KSKIP3 or not. When CSKIP<KSKIP3, the routine proceeds to step 129, while when CSKIP≧KSKIP3, the routine proceeds to step 128.

That is, when the purge action is restarted while the engine is idling, the value of PGRO is held at the purge rate of just before the purge action was stopped until the number of skips exceeds three. At step 120, the purge rate PGRO of just before the purge action was stopped is made the purge rate PGR, then the routine proceeds from step 127 to step 128. Next, at step 129, processing is performed to drive the purge control valve 17. This drive processing is shown in FIG. 11, therefore, an explanation will next be made of the drive processing of FIG. 11.

Figure 11:
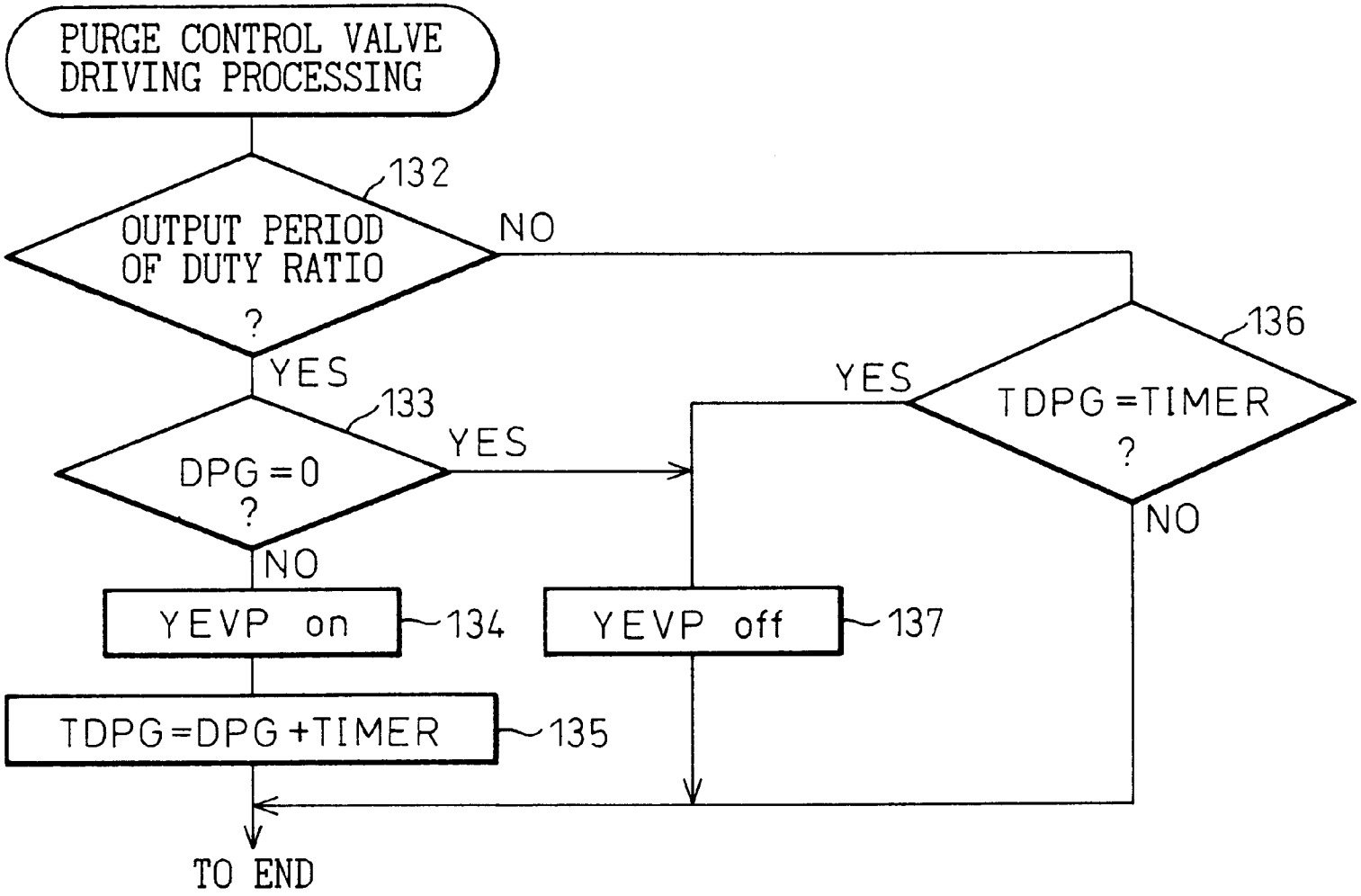
FIG. 11 is a flow chart for the processing for driving the purge control valve.

Referring to FIG. 11, first, at step 132, it is judged if the output period of the duty ratio, that is, the rising period of the drive pulse of the purge control valve 17, has arrived or not. The output period of the duty ratio is 100 msec. If the output period of the duty ratio has arrived, the routine proceeds to step 133, where it is judged if the duty ratio DPG is zero or not. When DPG=0, the routine proceeds to step 137, where the drive pulse YEVP of the purge control valve 17 is turned off. As opposed to this, when DPG is not 0, the routine proceeds to step 134, where the drive pulse YEVP of the purge control valve 17 is turned on. Next, at step 135, the duty ratio DPG is added to the current time TIMER to calculate the off time TDPG of the drive pulse (=DPG+TIMER).

On the other hand, when it is judged at step 132 that the output period of the duty ratio has not arrived, the routine proceeds to step 136, where it is judged if the current time TIMER is the off time TDPG of the drive pulse. When TDPG=TIMER, the routine proceeds to step 137, where the drive pulse YEVP is turned off.

Figure 12:
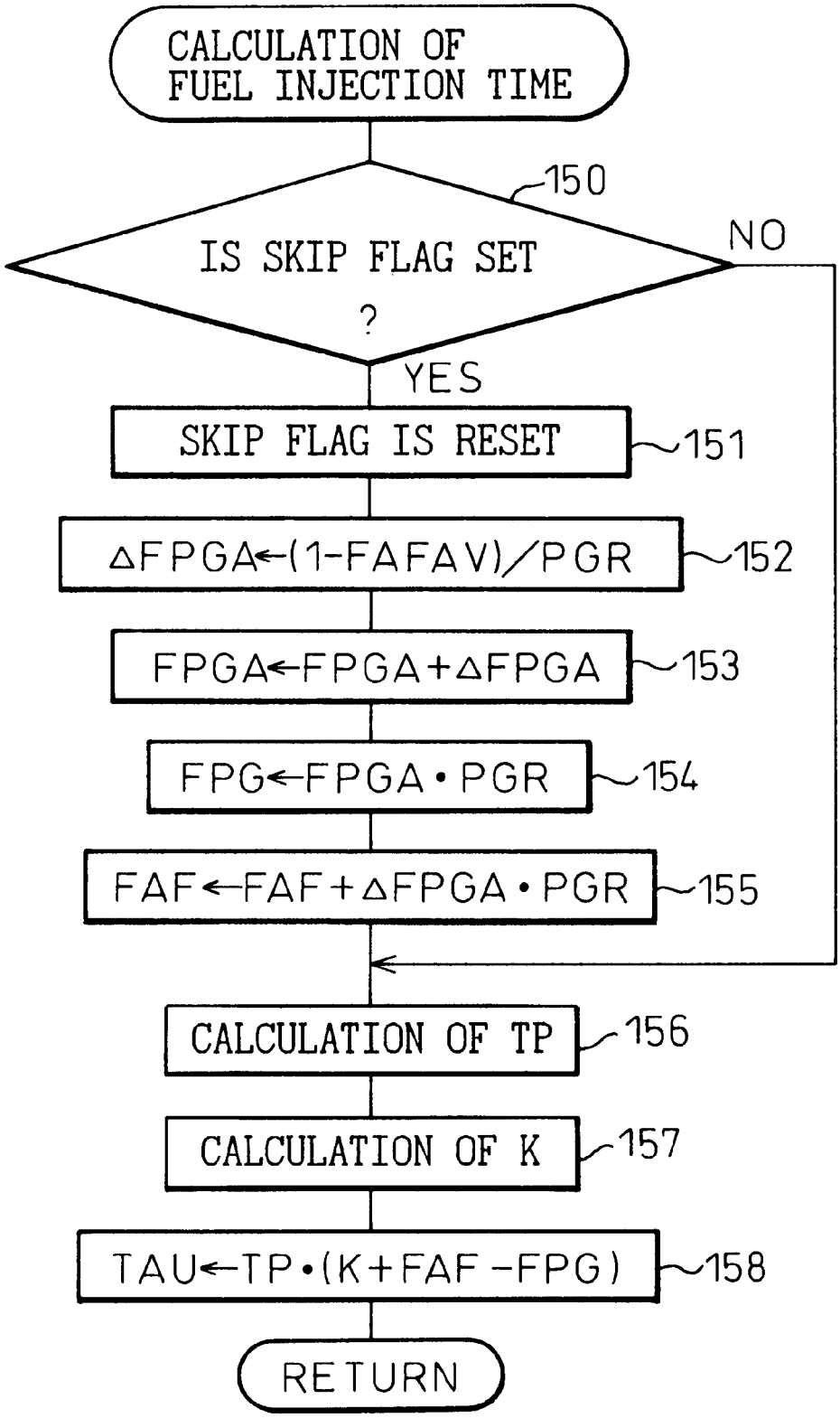
FIG. 12 is a flow chart of the calculation of the fuel injection time.

FIG. 12 shows the routine for calculation of the fuel injection time TAU. This routine is executed repeatedly.

Referring to FIG. 12, first, at step 150, it is judged if the skip flag which is set at step 45 of FIG. 2 has been set or not. When the skip flag has not been set, the routine jumps to step 156. As opposed to this, when the skip flag has been set, the routine proceeds to step 151, where the skip flag is reset, then the routine proceeds to step 152, where the purge vapor concentration ΔFPGA per unit purge rate is calculated based on the following formula:

$$\Delta FPGA=(1-FAFAV)/PGR$$

That is, the amount of fluctuation (1-FAFAV) of the average air-fuel ratio FAFAV shows the purge vapor concentration therefore by dividing (1-FAFAV) by the purge rate PGR, the purge vapor concentration ΔFPGA per unit purge rate is calculated. Next, at step 153, the purge vapor concentration ΔFPGA is added to the purge vapor concentration FPGA to update the purge vapor concentration FPGA per unit purge rate. When FAFAV approaches 1.0, ΔFPGA approaches zero, therefore FPGA approaches a constant value. Next, at step 154, the purge rate PGR is multiplied with FPGA to calculate the purge A/F correction coefficient FPG (=FPGA·PGR). Next, at step 155, ΔFPGA·PGR is added to FAF so as to increase the feedback control coefficient FAF by exactly the amount of the increase of the purge A/F correction coefficient FPG. Next, at step 156, the basic fuel injection time TP is calculated, then at step 157, the correction coefficient K is calculated, then at step 158, the injection time TAU (=TP·(k+FAF=FPG)) is calculated.

Figure 13:
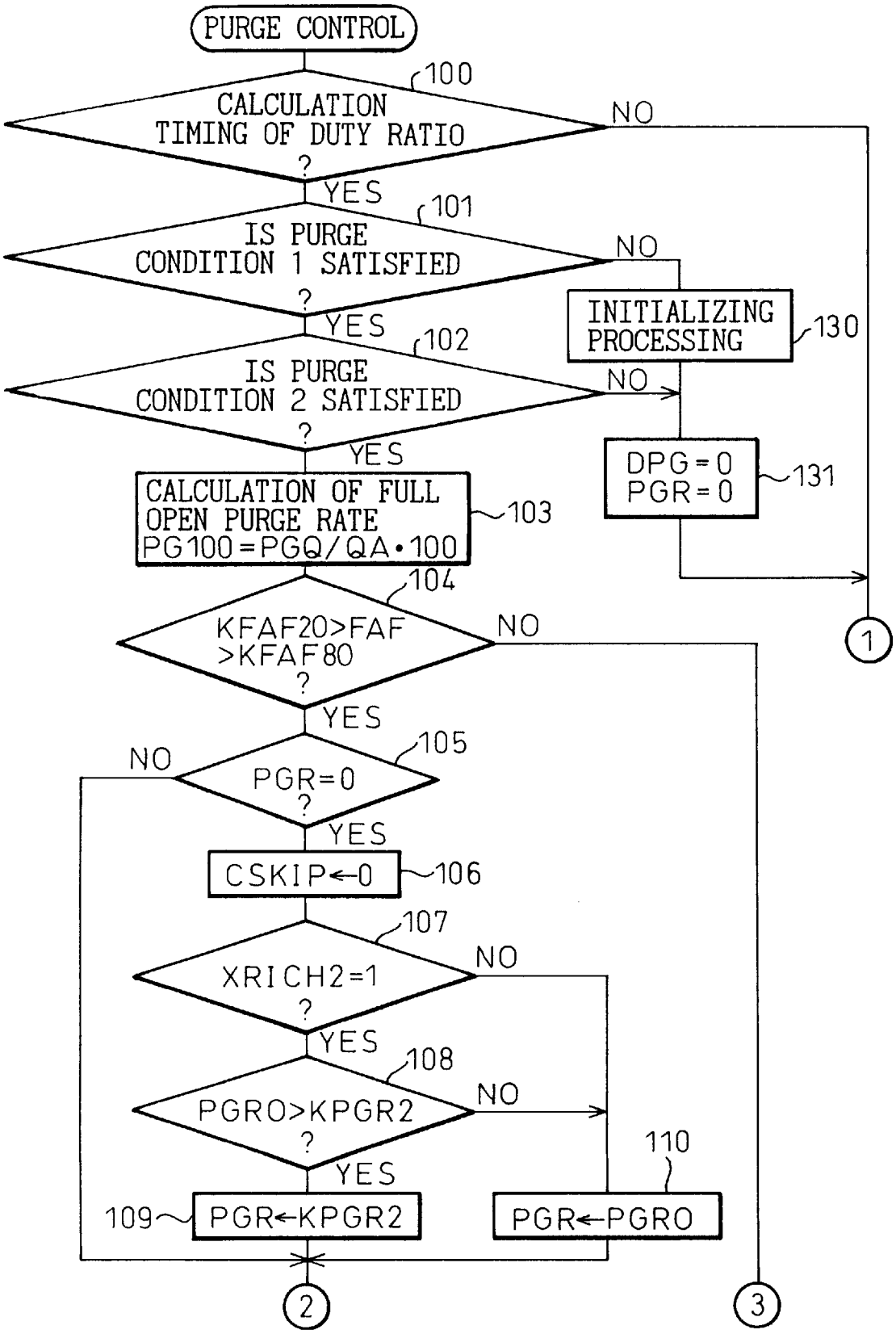
FIGS. 13 to 15 are flow charts of a second embodiment for the purge control.
Figure 14:
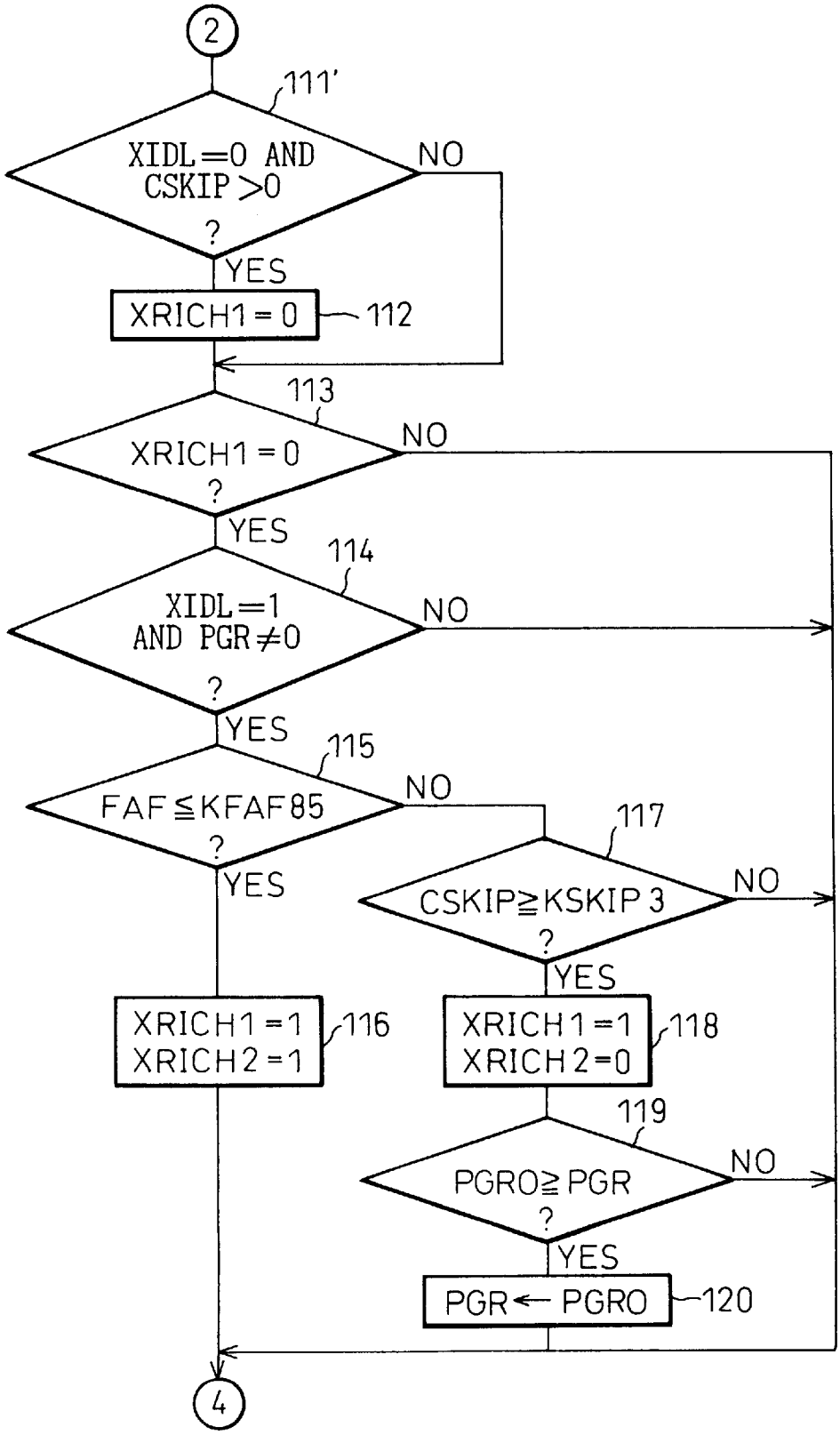
Figure 15:
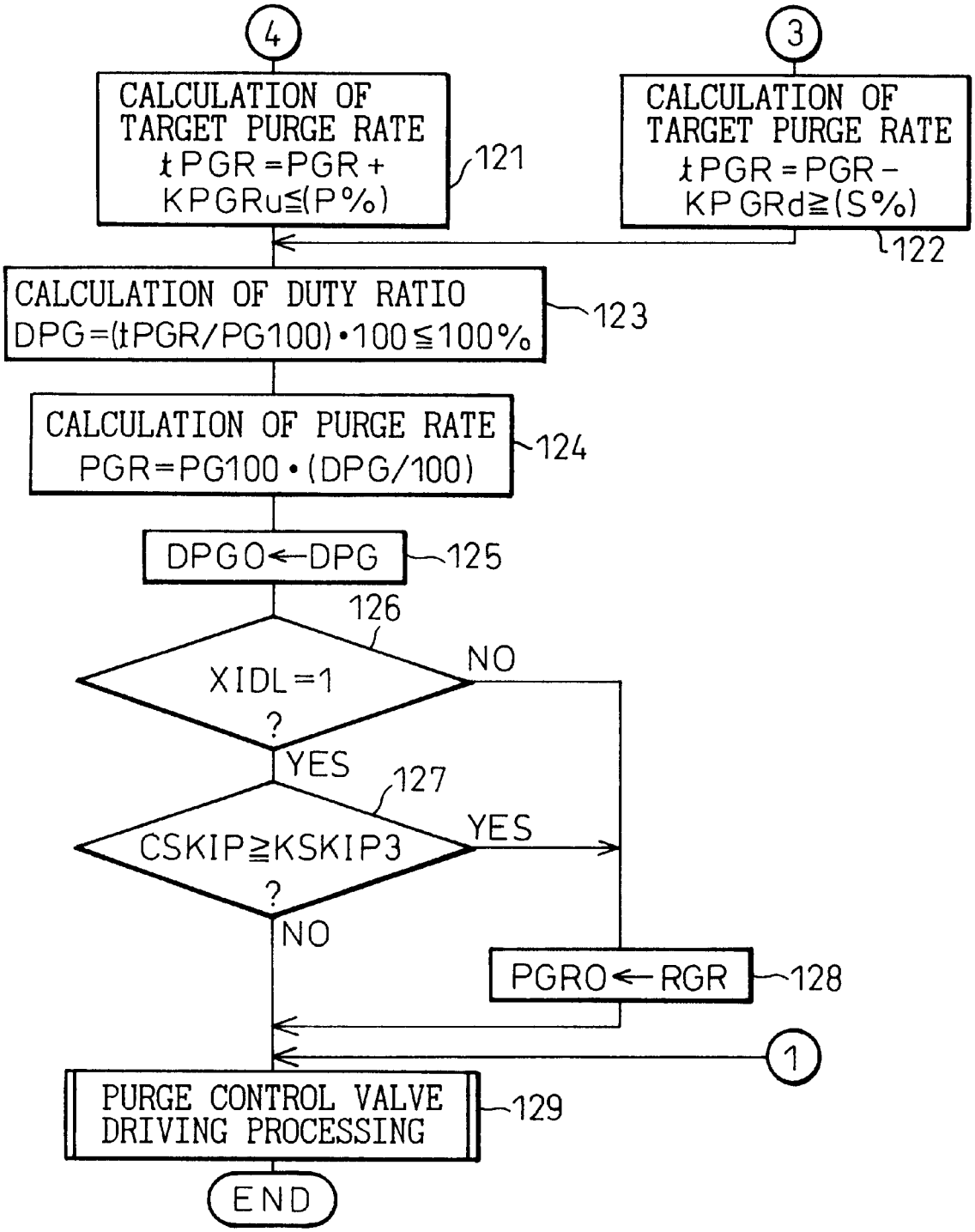

A second embodiment of the routine for control of the purge operation is shown in FIG. 13 to FIG. 15. Step 100 to step 129 of this routine correspond to step 100 to step 129 of FIG. 8 to FIG. 10. All the steps among step 100 to step 129 except for step 111' are the same as the corresponding steps of FIG. 8 to FIG. 10. Only step 111' differs from the corresponding step 111 of FIG. 8 to FIG. 10. Therefore, only step 111' of the second embodiment will be explained.

That is, referring to FIG. 14, at step 111', it is judged if the idling flag XIDL has been reset and the number of occurrences CSKIP of the skip action of the feedback correction coefficient FAF has reached three times or more. When the idling flag XIDL has been reset and the number of occurrences CSKIP of the skip action of the feedback correction coefficient FAF has reached three times or more, that is, when the engine is not idling and the feedback control of the air-fuel ratio is stable, the routine proceeds to step 112, where the judgement completion flag XRICH1 is reset.

That is, in the first embodiment shown in FIG. 8 to FIG. 10, the judgement completion flag was reset when the idling flag XIDL was reset, but in the second embodiment, the judgement completion flag is reset first only when the idling flag XIDL is reset and also the number of occurrences CSKIP of skip actions has reached three or more. In the first embodiment, further, the rich flag XRICH2 was set at the time of engine idling, the throttle valve 9 was temporarily opened after the learning of the purge vapor concentration FGPG had progressed, then the rich state of the air-fuel ratio was judged again when the engine again began idling. At this time, FAF>0.85 and therefore the rich flag XRICH2 was reset. That is, while the purge rate at the time of restart of a purge action after this should also have been kept low, it was no longer possible to keep the purge rate at the time of the restart of the purge low.

Therefore, in the second embodiment, when the throttle valve 9 is temporarily made to open, the judgement completion flag XRICH1 is reset when the number of occurrences CSKIP of the skip action reaches three or more to continue to set the rich flag XRICH2 so that the rich state of the air-fuel ratio is not judged again.

Figure 16:
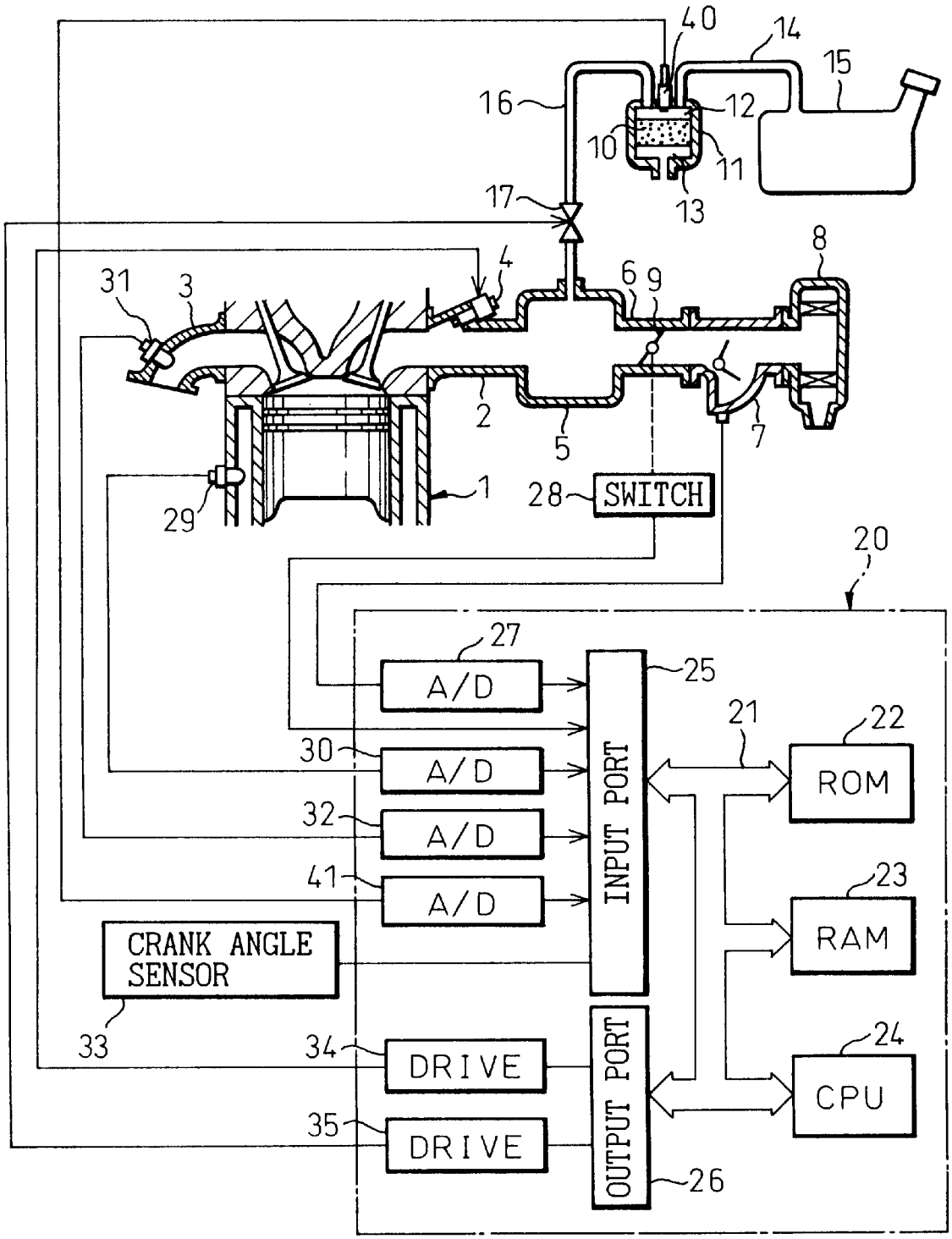
FIG. 16 is an overview of another embodiment of an internal combustion engine.

A third embodiment of the routine for control of the purge action is shown in FIG. 16 to FIG. 19. Referring to FIG. 16, in this embodiment, a pressure sensor 40 is arranged in the fuel vapor chamber 12. This pressure sensor 40 generates an output voltage proportional to the pressure in the fuel vapor chamber 12. This output voltage is input through an AD converter 41 to the input port 25.

Figure 17A:
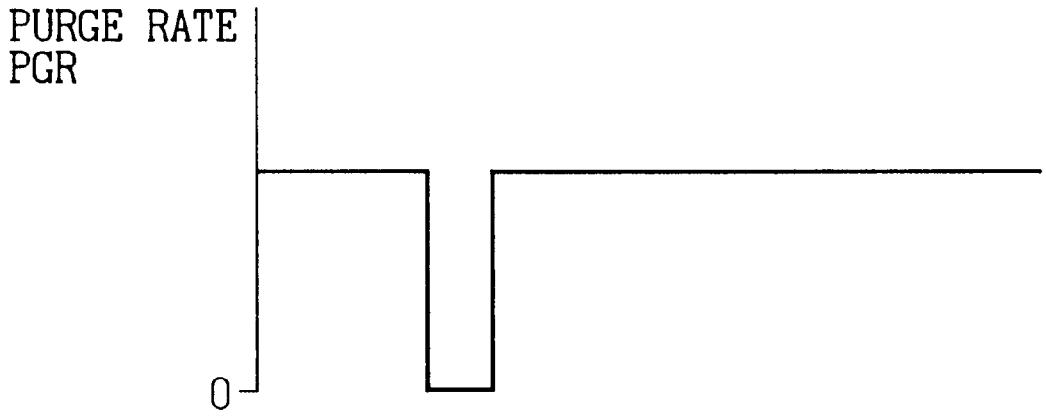
FIGS. 17A and 17B are time charts of changes in the purge rate PGR.
Figure 17B:
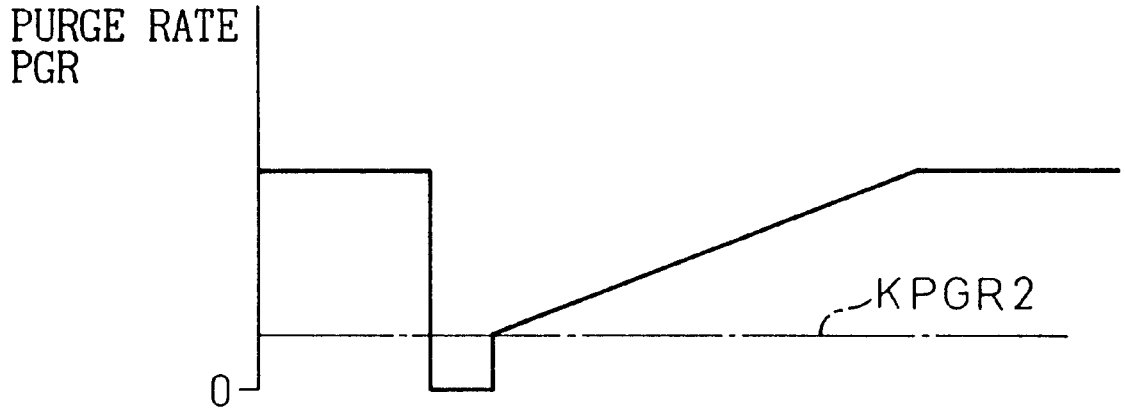

When the temperature of the fuel tank 15 is high, a large amount of evaporated fuel is produced in the fuel tank 15 while the purge action is stopped and as a result the pressure inside the fuel vapor chamber 12 rises. Therefore, in this third embodiment, when the pressure in the fuel vapor chamber 12 detected by the pressure sensor 40 exceeds a predetermined set value KPRN0 at the time of restart of the purge action, it is judged that the concentration of the fuel vapor to be purged has increased by a large margin while the purge action was stopped. Further, in the third embodiment, when the pressure in the fuel vapor chamber 12 is lower than the set value KPCN0 at the time of restart of the purge action, the purge action is restarted by the purge rate of just before the purge action was stopped as shown in FIG. 17A. When the pressure inside the fuel vapor chamber 12 is higher than the set value KPCN0 at the time of restart of the purge action, the purge action is restarted by the minimum purge rate KGRP2 as shown by FIG. 17B.

Figure 18:
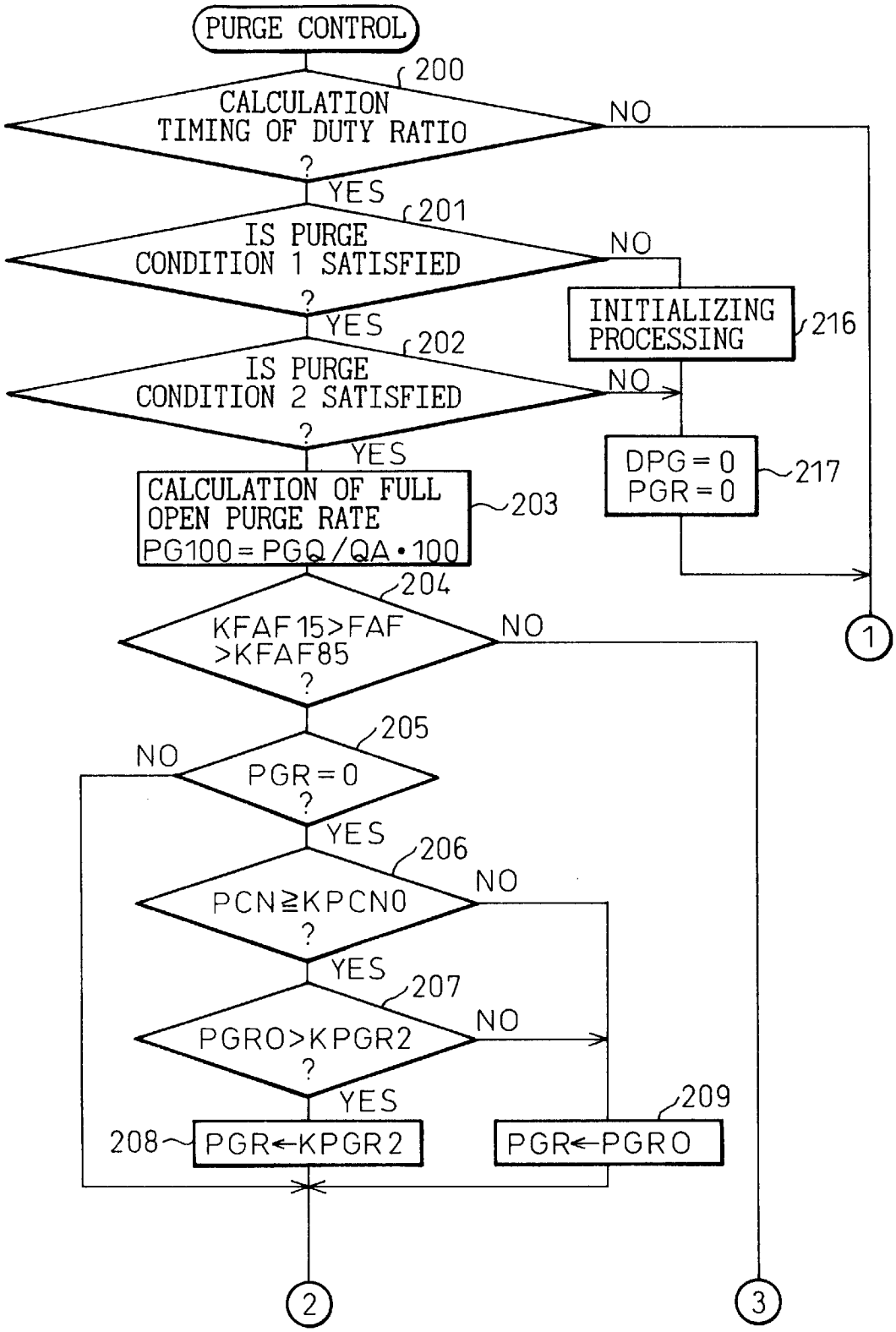
FIGS. 18 and 19 are flow charts of a third embodiment for the purge control.
Figure 19:
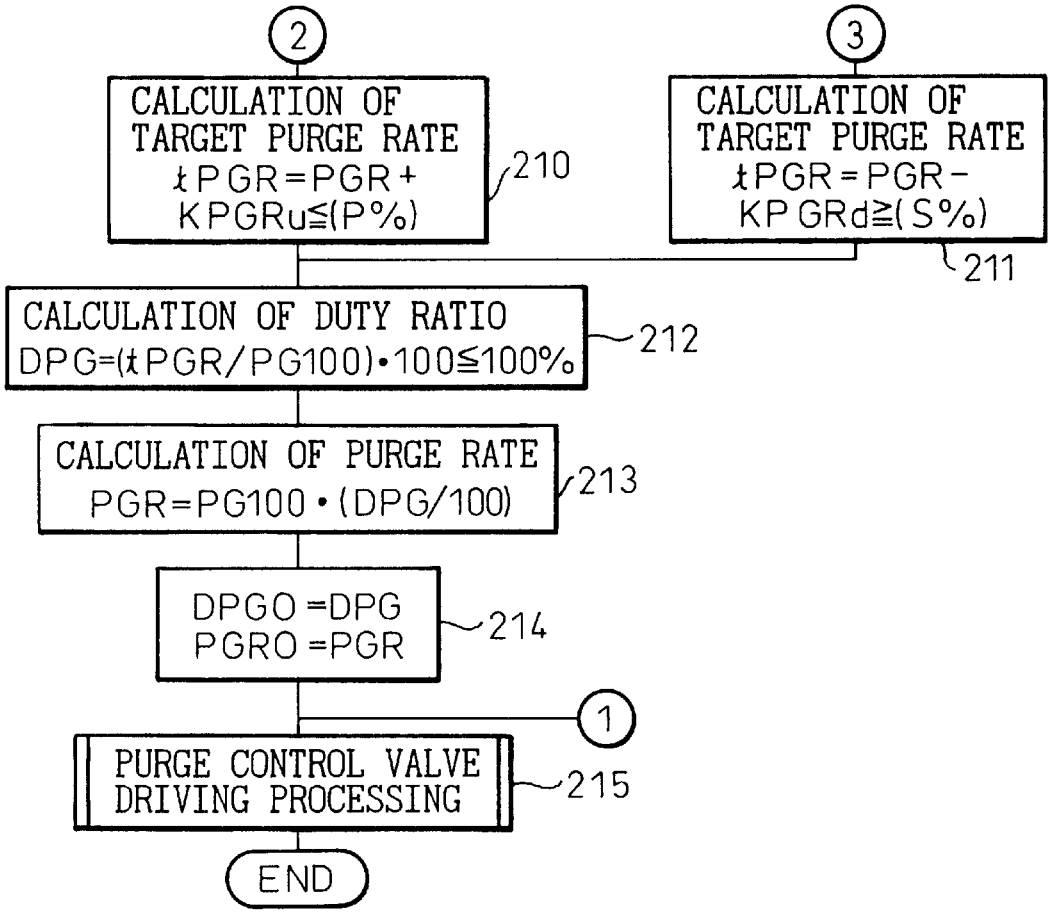

FIG. 18 and FIG. 19 show a routine for control of a purge action.

Referring to FIG. 18 and FIG. 19, first, at step 200, it is judged whether the time is the time of calculation of the duty ratio of the drive pulse of the purge control valve 17 or not. As explained above, in the embodiments according to the present invention, the duty ratio is calculated every 100 msec. When not the time for calculation of the duty ratio, the routine jumps to step 215, where the processing for driving the purge control valve 17 is executed. As opposed to this, when it is the time for calculation of the duty ratio, the routine proceeds to step 201, where it is judged if the purge condition 1 is satisfied or not, for example, if the engine warmup has been completed or not. When the purge condition 1 is not satisfied, the routine proceeds to step 216, where the initialization processing is performed, then at step 217, the duty ratio DPG and the purge rate PGR are made zero. As opposed to this, when the purge condition 1 is satisfied, the routine proceeds to step 202, where it is judged if the purge condition 2 is satisfied or not, for example, whether feedback control of the air-fuel ratio is being performed or not. When the purge condition 2 is not satisfied, for example, when the air-fuel ratio is not being feedback controlled due to the supply of fuel being stopped, the routine proceeds to step 217, while when the purge condition 2 is satisfied, the routine proceeds to step 203.

At step 203, the ratio between the full open purge amount PGQ and the amount QA of intake air, that is, the full open purge rate PG100 (=(PGQ/QA)·100) is calculated. Next, at step 204, it is judged if the feedback control coefficient FAF is between the upper limit value KFAF15 (=1.15) and the lower limit value KFAF85 (=0.85) or not. When KFAF15>FAF>KFAF85, that is, when the air-fuel ratio is being feedback controlled to the stoichiometric air-fuel ratio, the routine proceeds to step 205, where it is judged whether the purge rate PGR is zero or not. That is, when the purge action is being performed, PGR>0, so at this time the routine jumps to step 210. As opposed to this, when the purge action has not started, the routine proceeds to step 206, where it is judged if the pressure PCN in the fuel vapor chamber 12 is higher than the set value KPCNO based on the output signal of a pressure sensor 40.

When PCN<KPCN0, that is, when the concentration of the vapor to be purged has not become larger while the purge action was stopped, the routine proceeds to step 209, where the purge rate PGR0 of just before the purge action was stopped is made the purge rate PGR. Therefore, at this time, as shown by FIG. 17A, the purge action is restarted by the purge rate of just before the purge action was stopped. On the other hand, when it is judged at step 206 that PCN≧KPCN0, that is, when the concentration of the fuel vapor to be purged has increased by a large margin while the purge action was stopped, the routine proceeds to step 207.

At step 207, it is judged if the purge rate PGR0 of just before the purge action was stopped is larger than the minimum purge rate KPGR2 or not. When PGR0≦KPGR2, the routine proceeds to step 209, where the purge rate PGRO of just before the purge action was stopped is made the restart purge rate PGR, then the routine proceeds to step 210.

As opposed to this, when it is judged at step 207 that PGRO>KPGR2, the routine proceeds to step 208, where the minimum purge rate KPGR2 is made the restart purge rate PGR, then the routine proceeds to step 210. Therefore, at this time, as shown in FIG. 17B, the purge action is restarted from the minimum purge rate KPGR2.

At step 210, the constant value KPGRu is added to the purge rate PGR to calculate the target purge rate tPGR (=PGR+KPGRu), then the routine proceeds to step 212. On the other hand, when it is judged at step 204 that FAF≧KFAF15 or FAF≦KFAF85, the routine proceeds to step 211, where the constant value KPGRd is subtracted from the purge rate PGR to calculate the target purge rate tPGR (=PGR−KPGRd). Next, the routine proceeds to step 212.

At step 212, the target purge rate tPGR is divided by the full open purge rate PG100 to calculate the duty ratio DPG (=(tPGR/PG100)·100) of the drive pulse of the purge control valve 17. Next, at step 213, the duty ratio DPG is multiplied with the full open purge rate PG100 to calculate the actual purge rate PGR (=PG100·(DPG/100)). Next, at step 214, the duty ratio DPG is made DPG0 and the purge rate PGR is made PGR0. Next, at step 215, the processing for driving the purge control valve 17 shown in FIG. 11 is performed.

Figure 20:
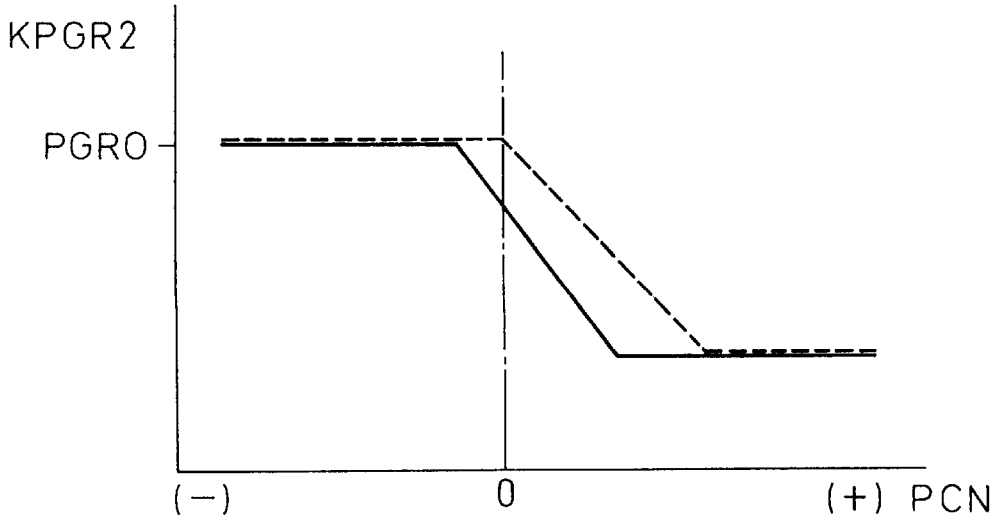
FIG. 20 is a view of a minimum purge rate KPGR2.
Figure 21:
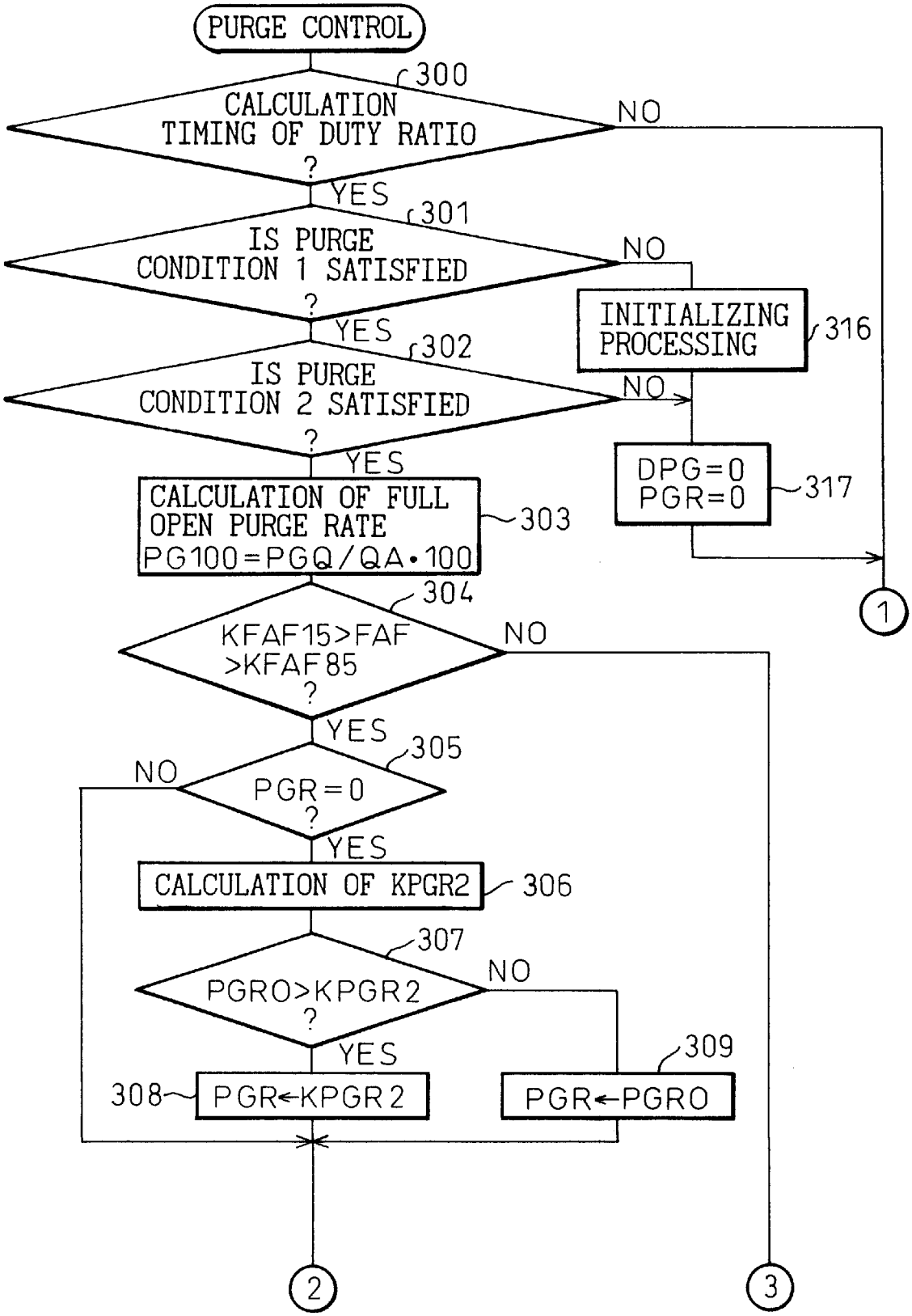
FIGS. 21 and 22 are flow charts of a fourth embodiment for the purge control.
Figure 22:
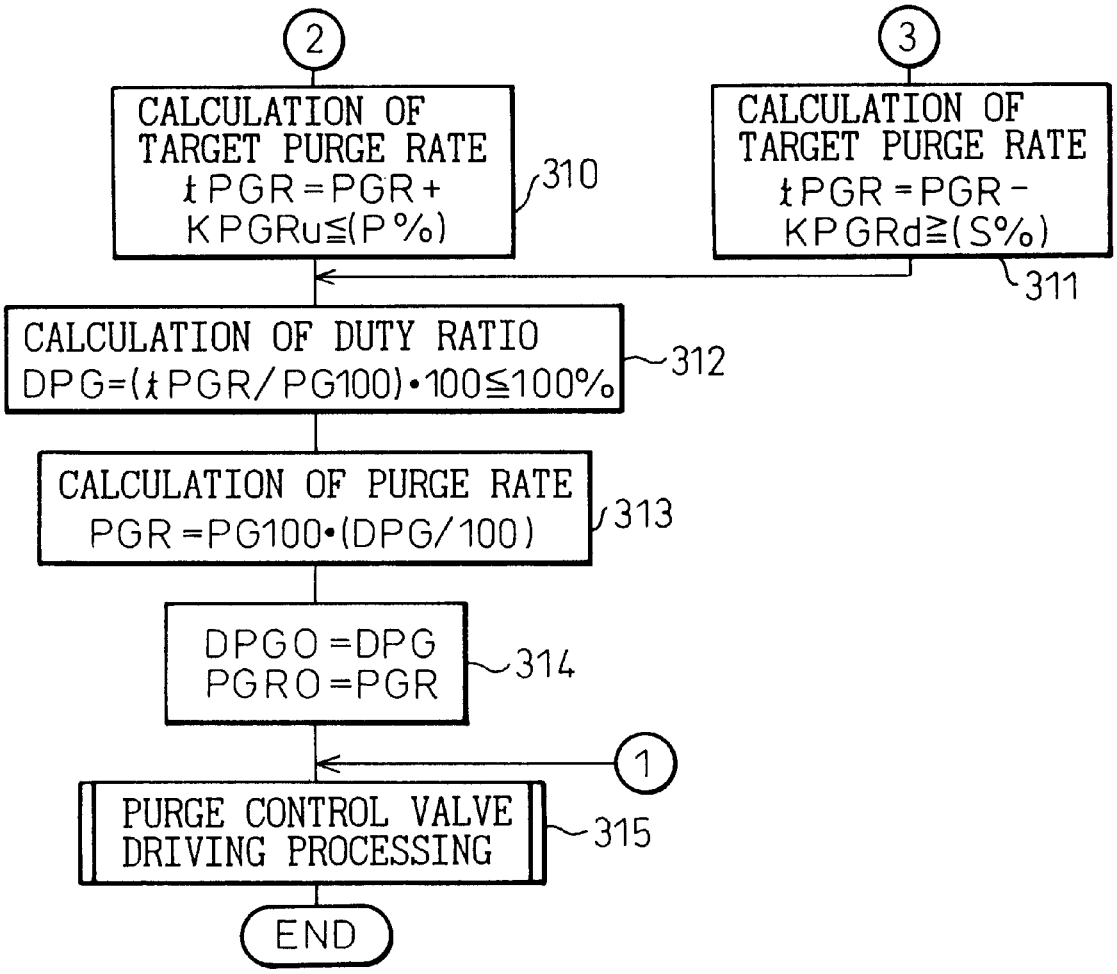

A fourth embodiment is shown in FIG. 20 to FIG. 22. In this embodiment, as shown in FIG. 20, the minimum purge rate KPGR2 is determined based on the pressure PCN in the fuel vapor chamber 12 at the time of restart of the purge action. Note that the pressure PCN shows the gauge pressure therefore the pressure 0 on the horizontal axis shows the atmosphere pressure. Further, in FIG. 20, the solid line shows when the amount of intake air is small, while the broken line shows when the amount of intake air is large.

As shown in FIG. 20, when the pressure PCN in the fuel vapor chamber 12 is negative (shown by broken line) or when it is negative by more than a constant value (shown by solid line), the minimum purge rate KPGR2 is made the purge rate PGR0 of just before the purge action was stopped. As opposed to this, when the pressure PCN in the fuel vapor chamber 12 is positive, the minimum purge rate KPGR0 is made smaller the higher the pressure PCN in the fuel vapor chamber 12. That is, the higher the pressure PCN in the fuel vapor chamber 12, the easier it is for the air-fuel ratio to fluctuate at the time of restart of the purge action, so the minimum purge rate KPGR0 is made smaller then higher the pressure PCN in the fuel vapor chamber 12.

Further, the effect of a change of the concentration of the fuel vapor on the air-fuel ratio becomes larger the smaller the amount of the intake air. Therefore, as shown in FIG. 20, even when the pressure PCN in the fuel vapor chamber 12 is the same, when the amount of intake air is small, the minimum purge rate KPGR2 is made smaller compared with the case where the amount of intake air is large.

FIG. 21 and FIG. 22 show a routine for control of a purge action.

Referring to FIG. 21 and FIG. 22, first, at step 300, it is judged whether the time is the time of calculation of the duty ratio of the drive pulse of the purge control valve 17 or not. As explained above, in the embodiments according to the present invention, the duty ratio is calculated every 100 msec. When not the time for calculation of the duty ratio, the routine jumps to step 315, where the processing for driving the purge control valve 17 is executed. As opposed to this, when it is the time for calculation of the duty ratio, the routine proceeds to step 301, where it is judged if the purge condition 1 is satisfied or not, for example, if the engine warmup has been completed or not. When the purge condition 1 is not satisfied, the routine proceeds to step 316, where the initialization processing is performed, then at step 317, the duty ratio DPG and the purge rate PGR are made zero. As opposed to this, when the purge condition 1 is satisfied, the routine proceeds to step 202, where it is judged if the purge condition 2 is satisfied or not, for example, whether feedback control of the air-fuel ratio is being performed or not. When the purge condition 2 is not satisfied, for example, when the air-fuel ratio is not being feedback controlled due to the supply of fuel being stopped, the routine proceeds to step 317, while when the purge condition 2 is satisfied, the routine proceeds to step 303.

At step 303, the ratio between the full open purge amount PGQ and the amount QA of intake air, that is, the full open purge rate PG100 (=(PGQ/QA)·100) is calculated. Next, at step 304, it is judged if the feedback control coefficient FAF is between the upper limit value KFAF15 (=1.15) and the lower limit value KFAF85 (=0.85) or not. When KFAF15>FAF>KFAF85, that is, when the air-fuel ratio is being feedback controlled to the stoichiometric air-fuel ratio, the routine proceeds to step 305, where it is judged whether the purge rate PGR is zero or not. That is, when the purge action is being performed, PGR>0, so at this time the routine jumps to step 310. As opposed to this, when the purge action has not started, the routine proceeds to step 306, where the minimum purge rate KPGR2 is calculated from the relation shown in FIG. 20 based on the pressure PCN inside the fuel vapor chamber 12 and the amount of intake air.

Next, at step 307, it is judged if the purge rate PGR0 of just before the purge action was stopped is larger than the minimum purge rate KPGR2 or not. When PGR0≦KPGR2, the routine proceeds to step 309, where the purge rate PGR0 of just before the purge action was stopped is made the restart purge rate PGR, then the routine proceeds to step 310.

As opposed to this, when it is judged at step 307 that PGR0>KPRG2, the routine proceeds to step 308, where the minimum purge rate KPGR2 is made the restart purge rate PGR, then the routine proceeds to step 310. At this time, the purge action is restarted from the minimum purge rate KPGR2 shown in FIG. 20.

At step 310, the constant value KPGRu is added to the purge rate PGR to calculate the target purge rate tPGR (=PGR+KPGRu), then the routine proceeds to step 312. On the other hand, when it is judged at step 304 that FAF≧KFAF15 or FAF≦KFAF85, the routine proceeds to step 311, where the constant value KPGRd is subtracted from the purge rate PGR to calculate the target purge rate tPGR (=PGR−KPGRd). Next, the routine proceeds to step 312.

At step 312, the target purge rate tPGR is divided by the full open purge rate PG100 to calculate the duty ratio DPG (=(tPGR/PG100)·100) of the drive pulse of the purge control valve 17. Next, at step 313, the duty ratio DPG is multiplied with the full open purge rate PG100 to calculate the actual purge rate PGR (=PG100·(DPG/100)). Next, at step 314, the duty ratio DPG is made DPG0 and the purge rate PGR is made PGR0. Next, at step 315, the processing for driving the purge control valve 17 shown in FIG. 11 is performed.

As mentioned above, according to the present invention, it is possible to prevent the air-fuel ratio from fluctuating by a large margin at the time of restart of a purge action.

While the invention has been described by reference to specific embodiments chosen for purposes of illustration, it should be apparent that numerous modifications could be made thereto by those skilled in the art without departing from the basic concept and scope of the invention.

I claim:

1. An evaporative fuel treatment device for an engine provided with an intake passage, comprising:

a purge control valve for controlling an amount of fuel vapor to be purged to the intake passage;

purge control means for restarting the purge of the fuel vapor after the purge of the fuel vapor has been stopped once during engine operation;

judgment means for judging, based on a change in an air-fuel ratio when the purge is restarted, whether a concentration of the fuel vapor to be purged into the intake passage rises to a predetermined concentration during a purge stop period during which the purge was stopped during engine operation; and restart purge rate control means for controlling a rate at which the fuel vapor is purged at the time of restart of the purge so that, when the concentration of the fuel vapor rises to the predetermined concentration during the purge stop period, the purge rate is less than a purge rate when the concentration of the fuel vapor does not rise to the predetermined concentration during the purge stop period.

2. An evaporated fuel treatment device as set forth in claim 1, wherein the restart purge rate control means restarts the purge action by a purge rate less than a predetermined purge rate when the concentration of the fuel vapor has risen to the predetermined concentration while the purge action was stopped and restarts the purge action by the purge rate of just before the purge action was stopped when the concentration of the fuel vapor did not rise to the predetermined concentration while the purge action was stopped.

3. An evaporated fuel treatment device as set forth in claim 2, wherein the restart purge rate control means restarts the purge action by the predetermined purge rate when the purge rate of just before the purge action was stopped is higher than the predetermined purge rate and the concentration of the fuel vapor rose to the predetermined concentration while the purge action was stopped and the restart purge rate control means restarts the purge action by the purge rate of just before the purge action was stopped when the purge rate of just before the purge action was stopped is lower than the predetermined purge rate and the concentration of the fuel vapor rose to the predetermined concentration while the purge action was stopped.

4. An evaporated fuel treatment device as set forth in claim 2, wherein the predetermined purge rate is a constant value.

5. An evaporated fuel treatment device as set forth in claim 1, wherein the judgement means judges that the concentration of the fuel vapor has risen to the predetermined concentration when the air-fuel ratio becomes rich when the purge action is restarted at the time of engine idling.

6. An evaporated fuel treatment device as set forth in claim 5, wherein when it is judged by the judgement means that the concentration of the fuel vapor has risen to the predetermined concentration when the purge action is restarted, the restart purge rate control means reduces the purge rate at the time of restart of the purge action when the purge action is next restarted and at times after that.

7. An evaporated fuel treatment device as set forth in claim 5, further comprising air-fuel ratio detecting means for detecting an air-fuel ratio and feedback control means for feedback control of the air-fuel ratio so that the air-fuel ratio becomes a target air-fuel ratio, said feedback control means controlling the air-fuel ratio to the target air-fuel ratio by correcting the amount of fuel supplied by a feedback correction coefficient which changes in accordance with the air-fuel ratio detected by the air-fuel ratio detecting means, the feedback correction coefficient fluctuating about a predetermined reference value when the air-fuel ratio is held at the target air-fuel ratio, and the judgement means judging that the concentration of the fuel vapor has risen to the predetermined concentration when the feedback correction coefficient becomes lower than a predetermined value when the engine is idling.

8. An evaporated fuel treatment device as set forth in claim 5, further comprising air-fuel ratio detecting means for detecting an air-fuel ratio, feedback control means for feedback control of the air-fuel ratio so that the air-fuel ratio becomes a target air-fuel ratio, purge vapor concentration calculating means for calculating a concentration of purge vapor based on the amount of fluctuation of the air-fuel ratio, and correcting means for correcting the amount of fuel supplied to the engine by the purge vapor concentration calculated by said purge vapor concentration calculating means, said feedback correction coefficient being changed in a skip fashion in the downward direction when the air-fuel ratio changes from lean to rich, said feedback correction coefficient being changed in a skip fashion in an upward direction when the air-fuel ratio changes from rich to lean, and releasing means is provided for releasing the action of reduction of the purge by the restart purge rate control means when the feedback correction coefficient has not fallen to less than a predetermined value up to when the skip change of the feedback correction coefficient occurs a predetermined number of times after the engine starts idling.

9. An evaporated fuel treatment device as set forth in claim 8, wherein stability discrimination means is provided for judging if feedback control of the air-fuel ratio by the feedback control means is stable in an operating state other than engine idling and wherein said judgement means judges if the concentration of the fuel vapor to be purged into the intake passage has risen to a predetermined concentration while the purge action is stopped during engine idling when the engine idles after the stability discrimination means judges that the feedback control of the air-fuel ratio is stable.

10. An evaporated fuel treatment device as set forth in claim 9, wherein the stability discrimination means judges that the feedback control of the air-fuel ratio is stable when the skip-like change of the feedback correction coefficient has been performed a predetermined time or more in a state other than engine idling.

11. An evaporated fuel treatment device as set forth in claim 1, wherein fuel vapor purge rate control means is provided for controlling the purge rate of the fuel vapor by controlling the amount of opening of the purge control valve and wherein the fuel vapor purge rate control means gradually increases the purge rate after restart of the purge action when the purge rate at the time of restart of the purge action has been made lower by the restart purge rate control means.

12. An evaporated fuel treatment device as set forth in claim 11, wherein the fuel vapor purge rate control means gradually increases the purge rate in the beginning after the restart of the purge action when the purge action is restarted during engine idling and then raises the purge rate to the purge rate of just before the purge action was stopped after the elapse of a predetermined time.

13. An evaporated fuel treatment device as set forth in claim 12, further comprising air-fuel ratio detecting means for detecting an air-fuel ratio, feedback control means for feedback control of the air-fuel ratio so that the air-fuel ratio becomes a target air-fuel ratio, purge vapor concentration calculating means for calculating a concentration of purge vapor based on the amount of fluctuation of the air-fuel ratio, and correcting means for correcting the amount of fuel supplied to the engine by the purge vapor concentration calculated by said purge vapor concentration calculating means, said feedback control means controlling the air-fuel ratio to a target air-fuel ratio by correcting the amount of fuel supplied by a feedback correction coefficient which varies in accordance with the air-fuel ratio detected by said air-fuel ratio detecting means, said feedback correction coefficient being changed in a skip fashion in a downward direction when the air-fuel ratio changes from lean to rich, said feedback correction coefficient being changed in a skip fashion in an upward direction when the air-fuel ratio changes from rich to lean, and said predetermined time is judged to have elapsed when the skip change of the feedback correction coefficient occurs a predetermined number of times after the restart of the purge action.

14. An evaporated fuel treatment device as set forth in claim 1, further comprising air-fuel ratio detecting means for detecting an air-fuel ratio, feedback control means for feedback control of the air-fuel ratio so that the air-fuel ratio becomes a target air-fuel ratio, purge vapor concentration calculating means for calculating a concentration of purge vapor based on the amount of fluctuation of the air-fuel ratio, and correcting means for correcting the amount of fuel supplied to the engine by the purge vapor concentration calculated by said purge vapor concentration calculating means, said feedback control means controlling the air-fuel ratio to a target air-fuel ratio by correcting the amount of fuel supplied by a feedback correction coefficient which varies in accordance with the air-fuel ratio detected by said air-fuel ratio detecting means, said feedback correction coefficient fluctuating about a predetermined reference value when the air-fuel ratio is maintained at the target air-fuel ratio, and the purge vapor concentration calculating means increasing the purge vapor concentration when the feedback correction coefficient has become smaller than said reference value and reducing the purge vapor concentration when the feedback correction coefficient has become larger than said reference value.

15. An evaporated fuel treatment device as set forth in claim 14, wherein the correcting means corrects the amount of fuel supplied so that the amount of fuel supplied becomes smaller the higher the concentration of the purge vapor.

16. An evaporated fuel treatment device as set forth in claim 1, wherein calculating means is provided for calculating a target purge rate and means is provided for finding a full open purge rate of the time when the purge control valve is fully open and wherein the amount of opening of the purge control valve is calculated by dividing the target purge rate by the full open purge rate.

* * * * *